US010416588B2

(12) United States Patent
Masu et al.

(10) Patent No.: US 10,416,588 B2
(45) Date of Patent: Sep. 17, 2019

(54) CHARGING MEMBER, PROCESS CARTRIDGE, ELECTROPHOTOGRAPHIC IMAGE FORMING APPARATUS, AND METHOD FOR MANUFACTURING CHARGING MEMBER

(71) Applicant: CANON KABUSHIKI KAISHA, Tokyo (JP)

(72) Inventors: Hiroki Masu, Tokyo (JP); Kazuhiro Yamauchi, Suntou-gun (JP); Yuichi Kikuchi, Susono (JP); Masaki Tsunoda, Numazu (JP); Takumi Furukawa, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/789,124

(22) Filed: Oct. 20, 2017

(65) Prior Publication Data

US 2018/0120727 A1 May 3, 2018

(30) Foreign Application Priority Data

Oct. 31, 2016 (JP) ..... 2016-213356

(51) Int. Cl.
*G03G 15/02* (2006.01)
*G03G 21/18* (2006.01)

(52) U.S. Cl.
CPC ..... *G03G 15/0233* (2013.01); *G03G 21/1814* (2013.01)

(58) Field of Classification Search
CPC ..... G03G 15/0233
See application file for complete search history.

(56) References Cited

U.S. PATENT DOCUMENTS 7,693,457 B2 4/2010 Kuruma et al.
7,962,068 B2 6/2011 Kuroda et al.
8,298,670 B2 10/2012 Muranaka et al.
(Continued)

FOREIGN PATENT DOCUMENTS

EP 0 606 907 A1 7/1994
JP H06-266206 A 9/1994
(Continued)

OTHER PUBLICATIONS

U.S. Appl. No. 15/543,656, Yuichi Kikuchi, filed Jul. 14, 2017.
(Continued)

*Primary Examiner* — David M. Gray
*Assistant Examiner* — Andrew V Do
(74) *Attorney, Agent, or Firm* — Venable LLP

(57) ABSTRACT

A charging member includes an electro-conductive substrate, an elastic layer, and a surface layer provided in this order. The elastic layer has, on an outer surface thereof, concave portions that are independent of each other, and hold insulating particles. The insulating particle is exposed to the surface of the elastic layer. A site in which an outer edge of the projection image derived from each of the insulating particles and an outer edge of a projection image derived from each of the concave portions are separated, exists. The charging member has convex portions derived from the insulating particles exposed to the surface of the elastic layer, and concave portions derived from the concave portions of the elastic layer. The surface layer has a volume resistivity of $1.0\times10^{15}$ Ωcm or more.

11 Claims, 4 Drawing Sheets

(56) References Cited

U.S. PATENT DOCUMENTS

| | | | |
|---|---|---|---|
| 8,445,113 | B2 | 5/2013 | Furukawa et al. |
| 8,449,975 | B2 | 5/2013 | Hirakoso et al. |
| 8,503,911 | B2 | 8/2013 | Suzumura et al. |
| 8,526,857 | B2 | 9/2013 | Tomomizu et al. |
| 8,622,881 | B1 | 1/2014 | Harada et al. |
| 8,628,854 | B2 | 1/2014 | Yamauchi et al. |
| 8,685,601 | B2 | 4/2014 | Nose et al. |
| 8,715,830 | B2 | 5/2014 | Yamada et al. |
| 8,771,818 | B2 | 7/2014 | Nishioka et al. |
| 8,852,743 | B2 | 10/2014 | Kikuchi et al. |
| 8,991,053 | B2 | 3/2015 | Watanabe et al. |
| 9,023,465 | B2 | 5/2015 | Yamada et al. |
| 9,086,643 | B2 | 7/2015 | Kikuchi et al. |
| 9,128,403 | B2 | 9/2015 | Yamauchi et al. |
| 9,146,482 | B2 | 9/2015 | Watanabe et al. |
| 9,360,789 | B1 | 6/2016 | Masu et al. |
| 9,360,833 | B2 | 6/2016 | Terada et al. |
| 9,442,408 | B2 | 9/2016 | Yamauchi et al. |
| 9,442,451 | B2 | 9/2016 | Yamauchi et al. |
| 9,541,854 | B2 | 1/2017 | Kikuchi et al. |
| 9,547,250 | B2 | 1/2017 | Kikuchi et al. |
| 9,551,949 | B2 | 1/2017 | Yamauchi et al. |
| 9,556,359 | B2 | 1/2017 | Suzumura et al. |
| 9,581,931 | B2 | 2/2017 | Yamada et al. |
| 9,599,913 | B2 | 3/2017 | Nishioka et al. |
| 9,639,009 | B2 | 5/2017 | Yamaguchi et al. |
| 9,651,888 | B2 | 5/2017 | Muranaka et al. |
| 9,665,028 | B2 | 5/2017 | Arimura et al. |
| 9,665,029 | B2 | 5/2017 | Hino et al. |
| 9,740,133 | B2 | 8/2017 | Yamauchi et al. |
| 9,811,009 | B2 | 11/2017 | Yamada et al. |
| 9,811,021 | B2 | 11/2017 | Muranaka et al. |
| 2008/0075505 | A1 | 3/2008 | Nagamori et al. |
| 2012/0308261 | A1 | 12/2012 | Tsuru et al. |
| 2013/0004206 | A1 | 1/2013 | Kuroda et al. |
| 2013/0034369 | A1 | 2/2013 | Masu et al. |
| 2013/0064571 | A1 | 3/2013 | Kodama et al. |
| 2013/0281276 | A1 | 10/2013 | Watanabe et al. |
| 2014/0072343 | A1 | 3/2014 | Masu et al. |
| 2014/0080691 | A1 | 3/2014 | Kurachi et al. |
| 2015/0198900 | A1 | 7/2015 | Yamada et al. |
| 2015/0331340 | A1 | 11/2015 | Nishioka et al. |
| 2015/0331342 | A1 | 11/2015 | Yamaguchi et al. |
| 2015/0331346 | A1 | 11/2015 | Yamauchi et al. |
| 2015/0331347 | A1 | 11/2015 | Arimura et al. |
| 2015/0331348 | A1 | 11/2015 | Doi et al. |
| 2016/0154323 | A1 | 6/2016 | Nishioka et al. |
| 2016/0154366 | A1 | 6/2016 | Yamauchi et al. |
| 2016/0161877 | A1 | 6/2016 | Masu et al. |
| 2016/0187801 | A1 | 6/2016 | Yamada et al. |
| 2016/0187809 | A1 | 6/2016 | Yamaguchi et al. |
| 2016/0299450 | A1 | 10/2016 | Takeno et al. |
| 2017/0115590 | A1 | 4/2017 | Furukawa et al. |
| 2017/0115591 | A1 | 4/2017 | Terada et al. |
| 2017/0210719 | A1 | 7/2017 | Nishioka et al. |

FOREIGN PATENT DOCUMENTS

| | | | |
|---|---|---|---|
| JP | 2008-83404 | A | 4/2008 |
| JP | 2014-126680 | A | 7/2014 |
| JP | 2016-18079 | A | 2/2016 |
| JP | 2016-110121 | A | 6/2016 |

OTHER PUBLICATIONS

U.S. Appl. No. 15/698,018, Kenji Takashima, filed Sep. 7, 2017.
U.S. Appl. No. 15/702,075, Yuichi Kikuchi, filed Sep. 12, 2017.
U.S. Appl. No. 15/703,148, Yuya Tomomizu, filed Sep. 13, 2017.

CHARGING MEMBER, PROCESS CARTRIDGE, ELECTROPHOTOGRAPHIC IMAGE FORMING APPARATUS, AND METHOD FOR MANUFACTURING CHARGING MEMBER

BACKGROUND OF THE INVENTION

Field of the Invention

The present invention relates to a charging member, a process cartridge, and an electrophotographic image forming apparatus.

Description of the Related Art

In an electrophotographic image forming apparatus (hereinafter, also referred to as an "electrophotographic apparatus") such as a laser beam printer, a plurality of components such as a photosensitive member, a charging member, a developing member, and a cleaning member may be integrally incorporated to produce a process cartridge, the cartridge configured to be detachably attached to the body of the apparatus. In recent years, higher image quality, higher speed, and higher durability have been demanded for the electrophotographic apparatus. In response to these requirements, there is a tendency to reduce the particle diameter of toner and use various types of external additives. As a result, dirt is deposited in larger amounts on the charging member. The dirt should be originally removed by a cleaning blade or the like in a cleaning step. However, as the output number of sheets is increased, a frictional resistance between a cleaning blade and a photosensitive member is increased. The dirt may escape the cleaning blade, and remain on the photosensitive member even after the cleaning step is performed. This dirt causes the dirt of the charging member by the contact between the dirt and the charging member.

A charging roller having controlled surface roughness is disclosed in Japanese Patent Application Laid-Open No. 2008-83404 as a charging roller which can reduce the adhesion of dirt such as remaining toner. Japanese Patent Application Laid-Open No. 06-266206 discloses a charging member having a surface coated with a fluorine compound having an excellent antifouling property.

The present inventors have observed the dirt adhering to the charging member in detail, and accordingly have confirmed that the dirt contains fine powder dirt and massive dirt.

According to studies conducted by the inventors, as disclosed in Japanese Patent Application Laid-Open No. 2008-83404, the provision of a convex portion derived from a particle on a surface provides an effect of decreasing the coefficient of friction of a surface layer to reduce the amount of adhesion of dirt when the charging member having controlled surface roughness is used. As disclosed in Japanese Patent Application Laid-Open No. 06-266206, the use of the charging member having the surface coated with the fluorine compound or the like also provides an effect of decreasing the coefficient of friction of a surface layer to reduce the amount of adhesion of dirt. However, the effect restrictively suppresses the adhesion of the massive dirt.

SUMMARY OF THE INVENTION

One aspect of the present invention is directed to providing a charging member which can also suppress the adhesion of massive dirt on a surface.

One aspect of the present invention is directed to providing a process cartridge and an electrophotographic image forming apparatus which can form a high-quality image.

According to one aspect of the present invention, there is provided a charging member comprising: an electro-conductive substrate, an elastic layer, and a surface layer in this order, the elastic layer having, on an outer surface thereof, concave portions that are independent of each other, and hold insulating particles respectively; the insulating being exposed to the surface of the elastic layer, wherein, when each of the concave portions and the insulating particles held in the respective concave portions are orthogonally projected on a surface of the electro-conductive substrate, and orthogonal projection image is obtained, in the orthogonal projection image, a site in which an outer edge of the projection image derived from each of the insulating particles and an outer edge of a projection image derived from each of the concave portions are separated, exists, and wherein the charging member has convex portions derived from the insulating particles exposed to the surface of the elastic layer, and concave portions derived from the concave portions of the elastic layer, and the surface layer has a volume resistivity of $1.0\times10^{15}$ Ωcm or more.

According to another aspect of the present invention, there is provided a method for manufacturing the charging member, the method including: preparing an unvulcanized rubber composition containing a rubber composition and insulating particles; supplying an electro-conductive substrate and the unvulcanized rubber composition to a cross-head extrusion-molding machine, where an unvulcanized rubber roller is obtained by taking over at a taking-over rate of 100% or less; and forming a surface layer on an outer circumference of the unvulcanized rubber roller, or an outer circumference of a vulcanized rubber roller obtained by vulcanizing rubber of the unvulcanized rubber roller.

According to further aspect of the present invention, there is provided a process cartridge configured to be detachably attachable to a body of an electrophotographic image forming apparatus, the process cartridge including an image bearing member and a charging member disposed in contact with the image bearing member, wherein the charging member is the above-mentioned charging member.

According to still further aspect of the present invention, there is provided an electrophotographic image forming apparatus including an image bearing member, a charging apparatus which charges the image bearing member, a developing apparatus which develops an electrostatic latent image formed on the image bearing member by use of a developer, and a transfer member which transfers the developer supported by the image bearing member to a transfer medium, wherein the charging apparatus includes the above-mentioned charging member.

Further features of the present invention will become apparent from the following description of exemplary embodiments with reference to the attached drawings.

DESCRIPTION OF THE EMBODIMENTS

Figure 1:
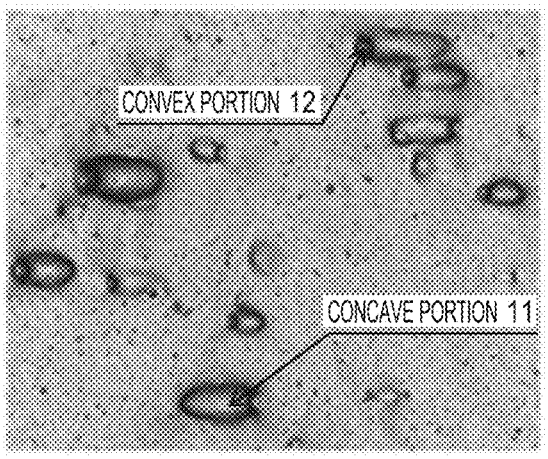
FIG. 1 is a view (photograph) showing an example of the surface form of a charging member according to the present invention.

Preferred embodiments of the present invention will now be described in detail in accordance with the accompanying drawings.

One of the reasons why the above-mentioned massive dirt adheres on the surface of a charging member is considered as follows. With the higher speed and higher durability of an electrophotographic image forming apparatus, frictional resistance between a cleaning blade and a photosensitive member is increased which causes the vibration or chipping of the cleaning blade. Residual toner on the photosensitive member becomes massive, and escapes the cleaning blade.

Even in an electrophotographic image forming apparatus having no cleaning blade and adopting a so-called cleaner-less system, the adhesion of massive dirt on the surface of a charging member might be observed. One of the reasons is considered as follows. That is, in the cleaner-less system, in order to reduce residual toner on a photosensitive member, a voltage applied in a transfer process is increased. As a result, it is considered that discharge to the photosensitive member from paper charged by applying a high voltage occurs, and the residual toner on the photosensitive member aggregates in a massive form.

A charging member according to one aspect of the present invention comprises an electro-conductive substrate, an elastic layer on the electro-conductive substrate, and a surface layer on the elastic layer. The elastic layer is made of a material containing an electro-conductive elastic body and electrically insulating particles. Hereinafter, the electrically insulating particles are referred as "insulating particles". The elastic layer has on an outer surface thereof, concave portions that are independent of each other. The concave portions hold insulating particles respectively. The insulating particles are held by the elastic layer in a state where it exposed to the surface of the elastic layer. That is, the insulating particles are not buried in a constituent material of the elastic layer excluding the insulating particles (electro-conductive elastomer or the like), and a part thereof is projected from the constituent material excluding the insulating particles (electro-conductive elastomer or the like). When each of the concave portions and the insulating particles held in the respective concave portions are orthogonally projected on a surface of the electro-conductive substrate, and orthogonal projection image is obtained, in the orthogonal projection image, a site in which an outer edge of the projection image derived from each of the insulating particles and an outer edge of a projection image derived from each of the concave portions are separated, exists. The elastic layer is covered with a thin layer of the surface layer, whereby the surface of the charging member has convex portions derived from the insulating particles exposed to the surface of the elastic layer, and concave portions derived from the concave portion of the elastic layer. The surface layer is an insulating thin film, and has a volume resistivity of $1.0\times10^{15}$ Ω·cm.

The present inventors presumed a mechanism in which the adhesion of the massive dirt to the surface layer can be suppressed by the charging member as follows.

FIG. 1 shows an image obtained by capturing the surface of the charging member. The surface of the charging member includes a concave portion 11 derived from the concave portion existing on the surface of the elastic layer. The surface of the charging member further forms a convex portion 12 derived from the insulating particles existing in the concave portion of the surface of the elastic layer, and at least a part of the peripheral wall of the convex portion 12 exists in a form (separation state) where it is not contact with the peripheral wall of the concave portion 11.

Figure 2A:
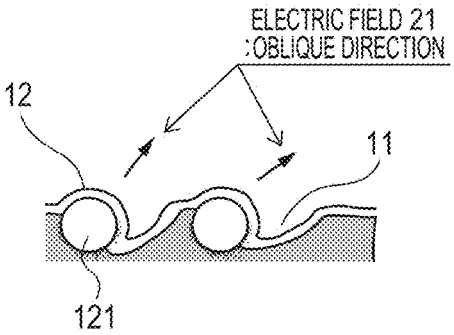
FIGS. 2A, 2B, 2C and 2D are sectional views schematically showing an example of the surface shape of the charging member according to the present invention.
Figure 2B:
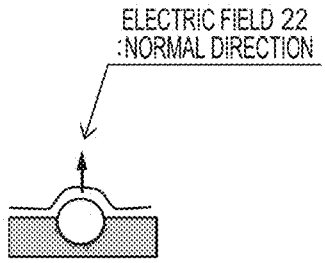

FIG. 2A schematically shows an example of the cross-section of the surface of the charging member. FIG. 2B schematically shows an example of the cross-section of the surface when the whole peripheral wall of the insulating particle 121 is in contact with the concave portion by way of comparison. First, in FIGS. 2A and 2B, a positive electric charge is accumulated in the insulating surface layer including the insulating particles in the process of the discharge to the photosensitive member from the surface of the charging member. Hereinafter, a phenomenon in which the electric charge is accumulated in the surface layer may be referred to as "charge-up". The present inventors consider that the charge-up of the surface layer occurs as follows.

When an electric field exceeds Paschen's law in a discharge space, air molecules are ionized, to generate electrons and positive ions, whereby first discharge occurs. Next, the generated electrons collide with many molecules in air while moving according to the applied electric field, and move in the direction of the photosensitive member while forming an electron avalanche. Since the collision of the electrons with the molecules always occurs at the tip of the electron avalanche, the electron avalanche proceeds while increasing a discharge charge quantity, and the electrons are eventually accumulated in the surface of the photosensitive member. As a result, the surface of the photosensitive member is charged.

On the other hand, the generated positive ions move in a direction reverse to that of the photosensitive member, i.e., to the surface of the charging member. Herein, when the volume resistivity of the surface layer of the charging member is low, the positive ions moving to the surface of the charging member pass through the surface layer, and escape the elastic layer and the electro-conductive substrate. When the volume resistivity of the surface layer is high, the positive ions are accumulated in the surface layer without allowing the positive ions to pass through the surface layer. That is, the surface layer is charged-up to a positive charge. In the charging member, in order to maintain the accumulation and charge-up of the positive ions in the surface layer, the volume resistivity of the surface layer is set to $1.0\times10^{15}$ Ω·cm or more.

Herein, in the surface layer in which the positive charge is accumulated, the convex portion derived from the insulating particles have a more accumulated amount of charge (hereinafter also referred to as charge-up amount) than that of a portion having no insulating particles. Herein, FIG. 2B is a sectional view of the vicinity of a convex portion derived from an insulating particles in a charging member having the convex portion and not having a concave portion in contact with the convex portion on a surface. In such a charging member, a local electric field 22 occurs in the "normal direction" of the surface of the charging member from the convex portion. The "normal direction" is the radial direction of a circle when the charging member is a cylindrical charging roller, or a direction perpendicular to the surface of the charging member when the charging member is a plate-like charging member. Therefore, the local electric field from the convex portion applies a force to the photosensitive member from the surface of the charging member in front of a nip between the charging member and the photosensitive member. When the massive dirt adheres on the surface of the photosensitive member, a force is applied in a direction in which the dirt is pressed against the photosensitive member, and the dirt then adheres and fixes on the surface of the charging member in the nip.

On the other hand, in the charging member according to an embodiment of the invention, as shown in FIG. 2A, the concave portion exists adjacent to the convex portion derived from the insulating particle of the charged-up surface layer, and the peripheral wall of the insulating particle and a part of the peripheral wall of the concave portion are not contact with each other. In this case, a force from the convex portion to the direction of the major axis of the concave portion is applied to the electric field which occurs from the convex portion having a more charge-up amount. As a result, the local electric field serves as an oblique electric field 21 inclined in an oblique direction from the normal direction of the surface of the charging member. The "major axis of concave portion" means the major axis of an ellipse obtained by subjecting the shape of the concave portion to elliptical approximation when the concave portion is seen from the surface of the charging member.

Then, even if a massive dirt has adhered to a surface of a photo sensitive member, a force is applied in an oblique direction with respect to the massive dirt immediately in front of the nip by the inclination of the local electric field from the convex portion. As a result, the dirt is scattered in a fine powder form. It is considered that accordingly, the adhering of the massive dirt is suppressed.

Figure 2C:
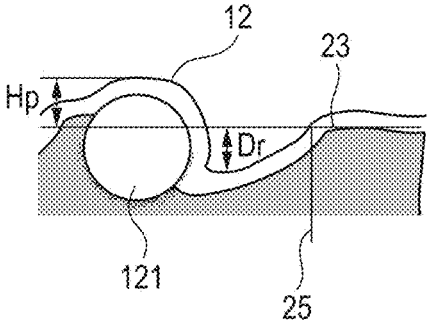

Cross-section shape at the vicinity of a surface of the charging member according to an embodiment of the invention is explained in more detail with using FIG. 2C. In the description of FIG. 2C, a height means a positive distance in a normal direction with respect to the surface of the charging member, and a depth means a negative distance in the opposite direction thereof. The concave portion existing in the outer edge of the insulating particle is defined as a hollow in which the position of the hollow thereof is lower than an average line 23 representing the position of the average height of the surface layer, and the depth Dr of the hollow is ⅓ or more of the average particle size Dm of the insulating particles. An outer edge 25 of the concave portion is defined as the circumference of the concave portion in which the outline of the concave portion and the average line 23 intersect with each other. The "average height of surface layer" is calculated by a method described in [Evaluation 3] to be described later.

The average particle size Dm of the insulating particles is preferably 6 μm or more and 20 μm or less. When the average particle size is 6 μm or more, the charge-up of the surface layer easily causes the local electric field from the convex portion derived from the insulating particle to occur. When the average particle size is 20 μm or less, local image defect caused by insufficient discharge from the convex portion derived from the insulating particle can be easily suppressed. A method for measuring the average particle size of the insulating particles will be described later.

Figure 2D:
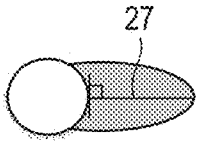

FIG. 2D shows an example of the concave portion and the insulating particle in an orthographic view obtained by orthographically projecting each of the concave portion and the insulating particle to the surface of the electro-conductive substrate (hereinafter, also referred to as "orthographic view of charging member"). A distance L of a region in which the outer edge of the insulating particle and the outer edge of the concave portion are separated from each other (hereinafter, also referred to as "distance of separation region") is preferably equal to or more than double for the average particle size Dm of the insulating particles. The distance L of the separation region is defined as a longest line segment including an intersection point of a straight line drawn in the normal direction from the outer edge of the circular insulating particle and the outer edge of the concave portion in the orthographic view of the charging member. When the distance L of the separation region is equal to or more than double ($2\ Dm \leq L$) for the average particle size Dm of the insulating particles, a force can be applied in an X direction in FIG. 2D to the local electric field from the convex portion, and the local electric field can be easily inclined.

From the viewpoint of easily inclining the local electric field from the convex portion, the height Hp of the convex portion of the insulating particle is preferably higher than the average line 23 representing the position of the average height of the surface layer, and preferably higher by 3 μm or more. Furthermore, from the same viewpoint, when the distance of the separation region is taken as L, the depth Dr of the concave portion is preferably 0.10 L or more with respect to the position of the average line.

The shape of the concave portion is not particularly limited to a hemispherical shape, a semielliptical spherical shape, and an indefinite shape or the like. An example of the shape of the concave portion is shown in FIG. 6A to FIG. 6D. FIG. 6A to FIG. 6D are orthographic views of the charging member.

Furthermore, in a projection view in a normal direction to the surface of the charging member, the position of the center of gravity of a gap surrounded by the outer edge of the insulating particle and the outer edge of the concave portion may preferably be oriented in the longitudinal direction of the charging member, i.e. an axial direction in the case of a charging roller, relative to the position of the center of gravity of the insulating particles.

This is because the charging roller as the charging member provides a high effect of applying a local electric field in the right-angled direction (axis direction) of the massive dirt escaping the cleaning blade and adhering in the form of a stripe in the rotation direction of the charging roller to scatter the dirt.

Figure 7:
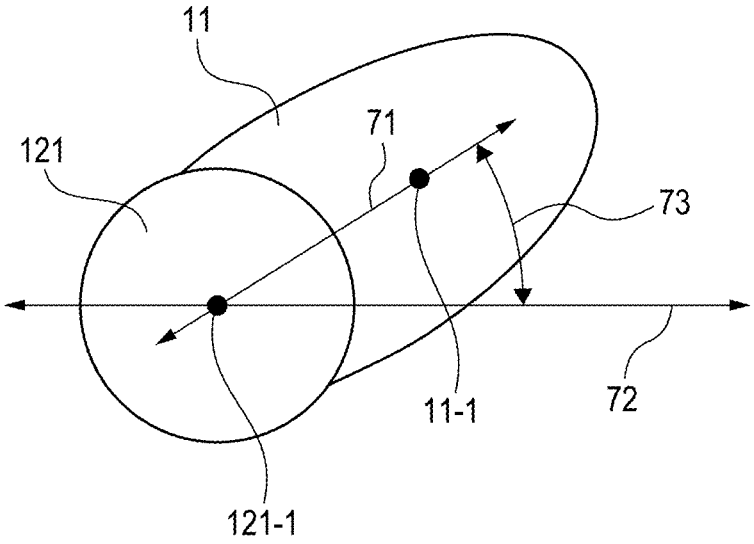
FIG. 7 is a schematic view for explaining the orientation of the position of the center of gravity of a gap relative to the position of the center of gravity of an insulating particle.

The degree of orientation may be represented by the average of an acute angle 73 formed, in a projection view (FIG. 7) from a point of view in a normal direction with respect to the surface of the charging member, between a line segment 71 connecting the center of gravity of the insulating particle 121-1 and the center of gravity of the gap 11-1, and the longitudinal direction 72 of the charging member. The value is between 0° and 90°, 90° means orientation in a direction orthogonal to the longitudinal direction (rotation direction in the case of a charging roller), 45° means non-orientation, and 0° means orientation in the longitudinal direction. When the angle is less than 45°, the center of gravity of the gap is oriented in the longitudinal direction of the charging member with respect to the center of gravity of the insulating particle. The angle is preferably 0° or more to 20° or less.

The number of the concave portions existing on the surface of the elastic layer and having the insulating particle existing therein is not particularly limited. The number of the concave portions is preferably about 0.2 or more and about 10 or less in a 100-μm square (length of 100 μm, width of 100 μm) on the surface of the surface layer.

Hereinafter, a suitable embodiment of the present invention will be described in detail.

<Constitution of Charging Member>

Figure 3:
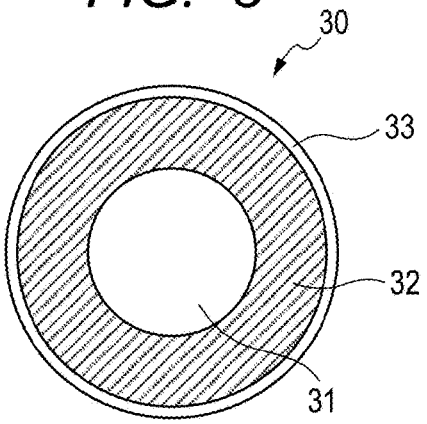
FIG. 3 is a schematic sectional view of the charging member according to the present invention.

FIG. 3 shows a cross-section perpendicular to the longitudinal direction of a charging member having a roller shape according to the present invention (hereafter, also referred to as a "charging roller"). A charging roller 30 shown in FIG. 3 includes an electro-conductive substrate 31, an elastic layer 32 on the peripheral surface of the electro-conductive substrate, and a surface layer 33 on the peripheral surface of the elastic layer. Then, elements constituting the charging member will be described in order.

<Electro-Conductive Substrate>

A substrate made of an electro-conductive material can be used as the electro-conductive substrate, and, for example, a metallic (alloy) support (e.g., a cylindrical metal) made of iron, copper, stainless steel, aluminum, an aluminum alloy, or nickel can be used.

<Elastic Layer>

(Electro-Conductive Elastomer Composition)

As a material constituting the elastic layer, an electro-conductive elastomer composition which is conventionally used for an electro-conductive elastic layer of a charging roller for an electrophotographic apparatus and is made of rubber or a thermoplastic elastomer or the like can be used.

Examples of the rubber include rubber or a rubber composition containing polyurethane rubber, silicone rubber, butadiene rubber, isoprene rubber, chloroprene rubber, styrene-butadiene rubber, ethylene-propylene rubber, polynorbornene rubber, styrene-butadiene-styrene rubber, and epichlorhydrin rubber or the like.

Examples of the thermoplastic elastomer include, but are not particularly limited to, a thermoplastic elastomer or a thermoplastic elastomer composition which contains one or two or more thermoplastic elastomers selected from a general-purpose styrene-based elastomer, olefin-based elastomer, amide-based elastomer, urethane-based elastomer, and ester-based elastomer or the like.

The conductive mechanism of the electro-conductive elastomer composition is roughly divided into two types: an ion conductive mechanism; and an electronic conductive mechanism.

The electro-conductive elastomer composition having the ion conductive mechanism is generally made of a polar elastomer typified by epichlorhydrin rubber, chloroprene rubber, and acrylonitrile-butadiene rubber (NBR) and an ion conductive agent. The ion conductive agent is ionized in the polar elastomer, and the ionized ion has high mobility. Examples of the ion conductive agent include inorganic ionic substances such as lithium perchlorate, sodium perchlorate and calcium perchlorate; quaternary ammonium salts such as lauryl trimethylammonium chloride, stearyl trimethylammonium chloride and tetrabutylammonium perchlorate; and inorganic salts of organic acids such as lithium trifluoromethanesulfonate and potassium perfluorobutanesulfonate. These ion conductive agents can be used alone or in combination of two or more thereof. Among the ion conductive agents, perchloric acid quaternary ammonium salt is preferable because of having stable electrical resistance against environmental change. However, the electro-conductive elastomer composition having the ion conductive mechanism has electrical resistance having large environmental dependence, and a mechanism having electro-conductivity exhibited when ions migrate may be apt to cause bleed and bloom.

On the other hand, the electro-conductive elastomer composition having the electronic conductive mechanism is generally obtained by dispersing and compounding carbon black, a carbon fiber, graphite, a metal fine powder, and a metal oxide or the like as an electro-conductive particle in an elastomer. The electro-conductive elastomer composition having the electronic conductive mechanism advantageously has electrical resistance having lower temperature-and-humidity dependence, less bleed and bloom, and a more inexpensive price than those of the electro-conductive elastomer composition having the ion conductive mechanism.

The electro-conductive particle is made of, for example, electro-conductive carbons such as Ketchen black EC and acetylene black; carbons for rubber such as SAF, ISAF, HAF, FEF, GPF, SRF, FT, and MT; metals and metal oxides, such as tin oxide, titanium oxide, zinc oxide, copper, and silver; and oxidation-treated carbon for color (ink), thermal decomposition carbon, natural graphite, and artificial graphite. These electro-conductive particles can be used alone or in combination of two or more thereof. It is preferable that the electro-conductive particle does not form a large convex portion. The electro-conductive particle having an arithmetic average particle diameter of 10 nm to 300 nm is preferably used.

The electro-conductive particle is preferably used in an amount so that the volume resistivity of the electro-conductive elastomer composition is set to $1\times10^3$ to $1\times10^9$ Ω-cm in a low-temperature and low-humidity environment (temperature: 15° C., relative humidity: 10%), a normal temperature-normal humidity environment (temperature: 23° C., relative humidity: 50%), and a high temperature-high humidity environment (temperature: 30° C., relative humidity: 80%). This is because a charging member exhibiting good charging performance is obtained. For example, the content of the electro-conductive particle can be set to 0.5 parts by mass or more and 100 parts by mass or less, and preferably 2 parts by mass or more and 60 parts by mass or less based on 100 parts by mass of a polymer (raw material elastomer).

The volume resistivity of the electro-conductive elastomer composition can be measured by a four terminal-four probe method, and can be measured with a resistivity meter (trade name: Loresta GP manufactured by Mitsubishi Chemical Analytech Co., Ltd.). In order to produce a sample, a rubber composition is placed in a 2-mm-thick mold, and crosslinked at a temperature of 160° C. under a pressure of 10 MPa for 10 minutes, to obtain a 2-mm-thick rubber sheet. The volume resistivity of the rubber sheet is measured by the four terminal-four probe method. Measurement is performed at a temperature of 23° C. and relative humidity of 50% under conditions of a correction coefficient of 4.532, an applied voltage of 90 V, and a load of 10 N using an ESP probe as a probe.

(Insulating Particle)

Insulating particles are used as the material constituting the elastic layer. In the charging member according to the present invention, the insulating particles are exposed to the surface of the elastic layer. Examples of the insulating particles include insulating particles having a volume resistivity of $10^{11}$ Ωcm or more. The volume resistivity of the insulating particles can be measured with a powder resistance measuring device (trade name: powder resistance measurement system MCP-PD51 type, manufactured by Mitsubishi Chemical Analytech Co., Ltd.) for measuring the volume resistivity of a pellet obtained by pressurizing the insulating particle. In order to pelletize the insulating particle to be measured, the insulating particle is placed in a cylindrical chamber having a diameter of 20 mm of the powder resistance measuring device. The filled amount of the insulating particles is set so that the thickness of the pellet when the insulating particles are pressurized at 20 kN is set to 3 to 5 mm. Measurement is performed at a temperature 23° C. and relative humidity of 50% under conditions of an applied voltage of 90 V and a load of 4 kN. The measuring method is adopted in "Evaluation 2" to be described later.

Examples of the material of the insulating particle include, but are not particularly limited to, a resin particle made of at least one resin selected from a phenol resin, a silicone resin, a polyacrylonitrile resin, a polystyrene resin, a polyurethane resin, a nylon resin, a polyethylene resin, a polypropylene resin, and an acrylic resin and the like; a resin particle made of a copolymer manufactured from two or more monomers as raw materials for the resins; an inorganic particle made of at least one inorganic substance selected from silica, alumina, and zirconia. As the insulating particle, two or more insulating particles can be used in combination. The insulating particles have preferably spherical particles. The spherical particles preferably have an average particle size of 6 μm or more and 20 μm or less.

(Measurement of Average Particle Size)

The average particle size Dm of the insulating particles are a "length average particle size" obtained by the following method. First, the insulating particle is observed with a scanning electron microscope (trade name: JEOL LV5910, manufactured by JEOL Ltd.) to capture an image. The captured image is analyzed with image analysis software (trade name: Image-Pro Plus, manufactured by Planetron Co). Analysis is made as follows: The number of pixels per unit length is calibrated from a micron bar at the time of capturing the image. The diameter in a given direction of each of the 100 particles randomly selected from the image is measured on the basis of the number of pixels on the image. The arithmetic mean particle diameter is obtained as the average particle size of the insulating particles.

(Sphericity)

Furthermore, regarding the sphericity of the insulating particles, the average value of a shape factor SF1 to be shown later is preferably 100 or more and 160 or less. Herein, the shape factor SF1 is an index represented by the following formula (1), and indicates that at a shape factor closer to 100, the particles have a more spherical shape. The average value of the shape factor of 160 or less makes it possible to easily suppress the wear and crack of the photosensitive member.

The shape factor SF1 of the insulating particle can be measured by the following method. The information of the image captured with the scanning electron microscope is fed to an image analyzer (trade name: Lusex 3, manufactured by Nireco Corporation) as in the measurement of the particle diameter. With respect to randomly selected 100 particle images, SF1 is calculated from the following formula (1). The average value is obtained by taking the arithmetic average.

$$SF1=\{(MXLNG)^2/AREA\}\times(\pi/4)\times(100) \quad \text{(Formula 1)}$$

where MXLNG represents the absolute maximum length of a particle, and AREA represents a projected area of the particle.

(Other Materials)

As the material constituting the elastic layer, other conductive agent, a filler, a processing aid, an age resistor, a cross-linking auxiliary agent, a cross-linking accelerator, a cross-linking accelerator aid, a cross-linking retarder, and a dispersant or the like can be used in addition to the above-mentioned electro-conductive elastomer composition and insulating particle.

Examples of the existence state of the concave portion of the elastic layer include a concave portion formed by depressing a part of the electro-conductive elastomer composition formed on the surface of the elastic layer.

The number of the elastic layers can also be increased. The increased number of the elastic layers makes it necessary to cause a layer containing the insulating particles to exist as the outermost surface. An adhesion layer can also be formed between the electro-conductive substrate and the elastic layer. The elastic layer is most preferably a single layer in order to simplify a production process in the present invention. In order to secure a NIP width with the photosensitive member, the thickness of the elastic layer in this case is preferably 0.8 mm or more and 4.0 mm or less, and particularly preferably 1.2 mm or more and 3.0 mm or less.

Furthermore, a unit for using the surface of the elastic layer formed by crosshead extrusion as it is preferable as a unit for forming a particular surface of the charging member of the present invention because of the simplification of a production process. Furthermore, the surface of the elastic layer may be subjected to a surface treatment for irradiating the surface of the elastic layer with ultraviolet rays or electron beams for the purpose of preventing bleed and bloom from the elastic layer to the surface layer.

<Surface Layer>

Examples of the material constituting the surface layer of the charging member include a binder resin, and an additive or the like can be used in combination as necessary.

(Binder Resin)

A known binder resin can be used as the binder resin. Examples thereof include resins and rubbers such as natural rubbers, vulcanized natural rubbers and synthetic rubbers. A fluorine resin, a polyamide resin, an acrylic resin, a polyurethane resin, a silicone resin, and a butyral resin or the like can be used as the resins. A copolymer manufactured from two or more monomers as raw materials for the resins can be used.

These binder resins can be used alone or in combination of two or more thereof. Among these, in order to strictly control the volume resistivity of the surface layer, rubber, acrylic resin, and polyurethane resin having a polyolefin skeleton are preferably used. Furthermore, among the rubber, acrylic resin, and polyurethane resin having a polyolefin skeleton, the rubber, acrylic resin, and polyurethane resin having a polyisobutylene skeleton, a polyisoprene skeleton, a polyisoprene hydride skeleton, a polybutadiene skeleton, and a polybutadiene hydride skeleton are preferable. This is because these resins have a high volume resistivity of $1.0\times10^{15}$ Ωm or more which can be easily attained.

In order to maintain the volume resistivity of the surface layer at $1.0\times10^{15}$ Ωm or more, it is preferable that the surface layer does not contain the conductive agent such as the ion conductive agent or the conductive particle.

(Other Additives)

Other additives may be added as necessary as long as the effects of the present invention are not impaired. The surface layer preferably contains a silicone additive from the viewpoints of improving the resistance of the surface layer, and applying a sliding property to the surface layer. The surface layer may be subjected to modification, introduction of a functional group or molecular chain, coating or a surface treatment with a releasing agent or the like without impairing the effects of the present invention.

The surface layer can be formed by a coating method such as electrostatic spray coating, dipping coating or ring coating. The surface layer may also be formed by adhesion or covering of an elastic layer with a layer having a sheet or tube shape formed in advance with a predetermined film thickness. A method for curing and molding a material into a predetermined shape in a mold may also be used. Among these, the surface layer is preferably formed by applying a coating liquid containing materials for the surface layer to the surface of the elastic layer by a coating method, followed by drying.

The physical properties such as kinetic friction and surface free energy of the surface layer can be adjusted by the surface treatment of the surface layer. Specific examples thereof include a method for irradiating the surface layer with active energy beams. Examples of the active energy beams include ultraviolet rays, infrared rays and electron beams.

(Film Thickness of Surface Layer)

When the maximum and minimum values of the film thickness of the surface layer in a viewing field of an optical microscope or electron microscope are respectively defined as $T_{max}$ and $T_{min}$ in the present invention, it is preferable that $T_{max}$ is 1 μm or more and $T_{max}$ is 5 μm or less. When the minimum value of the film thickness is 1 μm or more, charged-up attenuation caused by the positive charge of the charged-up surface layer passing to the elastic layer can be easily controlled. When the maximum value of the film thickness is 5 μm or less, the occurrence of image defect (fog) caused by insufficient discharge between the surface of the charging member and the photosensitive member can be easily suppressed. The film thickness of the surface layer can be measured by cutting out the cross-section of the roller with a sharp knife to obtain a sample, and observing the obtained sample under an optical microscope or an electron microscope.

(Volume Resistivity of Surface Layer)

The volume resistivity of the surface layer is $1.0\times10^{15}$ Ωcm or more. When the volume resistivity of the surface layer is small, the amount of adhesion of dirt deposited on the charging member is increased, and a longitudinal streak image and pinpoint image caused by dirt existing as a lump occur. The present inventors consider that this is because the positive charge on the surface layer charged-up immediately after discharging passes to the electro-conductive substrate and disappears, so that a local electric field sufficient for scattering dirt cannot be generated. In order to scatter the dirt in the local electric field, the surface layer having high resistance is required, which makes it necessary to set the volume resistivity of the surface layer to $1.0\times10^{15}$ Ωcm or more.

The volume resistivity of the surface layer can be measured using an atomic force microscope (AFM) to obtain a measured value measured in a conductive mode. First, the surface layer of a charging roller is cut into a sheet piece using a manipulator, and a metal is vapor-deposited on one surface of the surface layer. A direct-current power supply is connected to the metal-vapor-deposited surface and allowed to apply a voltage thereto. A free end of a cantilever is contacted with the other surface of the surface layer to obtain a current image through the body of AFM. One hundred points on the surface of the surface layer are randomly selected, and current values at the 100 points are measured. The volume resistivity can be calculated from the average current value of top 10 points of measured low current values, the average thickness, and the contact surface of the cantilever.

<Method for Manufacturing Charging Member>

As an example of a method for manufacturing a charging member, a method for manufacturing an elastic layer which is effective from the viewpoint that a manufacturing process is simple will be described. That is, a method for manufacturing an elastic layer will be described, the elastic layer including a convex portion formed by an insulating particle existing adjacent to a concave portion by extrusion molding, and forming a surface with which a part of the concave portion and a part of a peripheral wall of the convex portion are not in contact.

The manufacturing method is a method for manufacturing an elastic layer (hereinafter, also referred to as a "method [1]") which includes the following two steps, and forms a concave portion on a surface. In the elastic layer, an interface between an insulating particle and an electro-conductive rubber composition is peeled off.

Step 1: a step of preparing an unvulcanized rubber composition made of a rubber composition and insulating particles.

Step 2: a step of supplying an electro-conductive substrate and the unvulcanized rubber composition to a crosshead extrusion-molding machine where an unvulcanized rubber roller is obtained by taking over at a taking-over rate of 100% or less.

The step 2 is a step of forming a layer made of the unvulcanized rubber composition on the outer circumference of the electro-conductive substrate (mandrel) while elongating the unvulcanized rubber composition in an extrusion direction.

[Step 1]

First, an unvulcanized rubber composition is prepared, which constitutes an elastic layer in the step 1 and contains a conductive rubber composition and insulating particles. The insulating particles have preferably spherical shape having an average particle size of 6 μm or more and 20 μm or less. The content of the insulating particles in the unvulcanized rubber composition is preferably 5 parts by mass or more and 50 parts by mass or less based on 100 parts by mass of raw material rubber. The content of 5 parts by mass or more easily causes the insulating particles to exist on the surface of the elastic layer, which can particularly decrease a contact surface with a photosensitive member. The content of 50 parts by mass or less can avoid an increase in the existence amount of the insulating particles on the surface of the elastic layer to easily prevent the surface layer from hardening.

The elongation at break of the unvulcanized rubber composition is preferably controlled to a moderate value. The present inventors found that a distance L of a separation region in which the insulating particles and a part of the peripheral wall are in contact with each other can be controlled by an elongation at break in a tensile test of the unvulcanized rubber. The elongation at break is measured based on JIS K6254-1993 using a tensile test machine (trade name: RTG-1225, manufactured by A&D Co., Ltd.) under conditions of a tensile speed of 500 mm/min, break measurement sensitivity of 0.01 N, distance between surface lines of 20 mm, sample width of 10 mm, thickness of 2 mm, test temperature of 25° C., and number of measurements of 2.

The present inventors consider that the elongation at break serves as an index for stress relaxation when a minute crack (hole) having a diameter of 3 μm or less occurs. Therefore, the concave portion formed by the peeling-off of the interface between the insulating particles and the electro-conductive rubber composition when stress concentrates at the interface is less likely to occur when the stress relaxation is likely to be provided by the minute crack. That is, the concave portion can be said to be less likely to occur in unvulcanized rubber having a small elongation at break. In order to control the stress relaxation caused by the minute crack, a filler having a low reinforcing property is preferably mixed. Calcium carbonate is particularly preferable since the adjustment range of the elongation at break according to the amount of addition is wide. In order to form the concave portion having a suitable size, the elongation at break is preferably 50% or more and 80% or less.

In addition, the formation of the concave portion provided by peeling-off can be controlled also by the Mooney viscosity of the unvulcanized rubber composition, the difference in polarity between the insulating particle and the conductive rubber composition, and the adherence property of the unvulcanized rubber composition. A raw material rubber having a higher Mooney viscosity can provide a larger concave portion.

[Step 2]

In order to peel off the interface between the insulating particles and the conductive rubber composition to form the concave portion, the unvulcanized rubber composition is molded while it is extended in an extrusion direction using a crosshead extrusion-molding machine. The crosshead extrusion-molding machine is a molding machine into which an unvulcanized rubber composition and a mandrel having a predetermined length are simultaneously fed. An unvulcanized rubber roller in which the outer circumference of the mandrel is equally covered with a rubber material having a predetermined thickness is extruded from the outlet port of a crosshead.

Figure 4A:
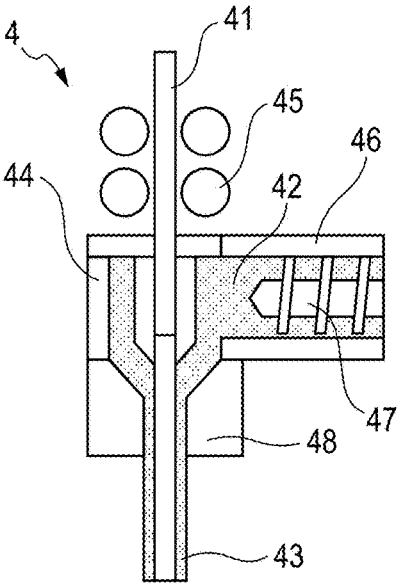
FIGS. 4A and 4B are schematic structure views of an example of a crosshead extrusion-molding machine.

FIG. 4A is a schematic structure view of a crosshead extrusion-molding machine 4. By equally covering the whole outer circumference of a mandrel 41 with an unvulcanized rubber composition 42 by the crosshead extrusion-molding machine, an unvulcanized rubber roller 43 including the mandrel 41 placed at the center can be manufactured. The crosshead extrusion-molding machine is provided with a crosshead 44 into which the mandrel 41 and the unvulcanized rubber composition 42 are fed, a conveying roller 45 feeding the mandrel 41 into the crosshead 44, and a cylinder 46 feeding the unvulcanized rubber composition 42 into the crosshead 44.

The conveying roller 45 continuously feeds a plurality of mandrels 41 into the crosshead 44. The cylinder 46 includes a screw 47 provided therein. The unvulcanized rubber composition 42 can be fed into the crosshead 44 by the rotation of the screw 47. When the mandrel 41 is fed into the crosshead 44, the whole outer circumference of the mandrel 41 is covered with the unvulcanized rubber composition 42 fed into the crosshead from the cylinder 46. The mandrel 41 is discharged as the unvulcanized rubber roller 43 having a surface covered with the unvulcanized rubber composition 42 from a dice 48 of the outlet port of the crosshead 44.

By molding the unvulcanized rubber composition so that the thickness of the unvulcanized rubber composition is thinner than that of a gap of an extrusion port of the crosshead, i.e., by molding the unvulcanized rubber while extending the unvulcanized rubber in the longitudinal direction of the mandrel, the interface between the spherical particle and the electro-conductive rubber composition is peeled off, to form the concave portion.

Figure 4B:
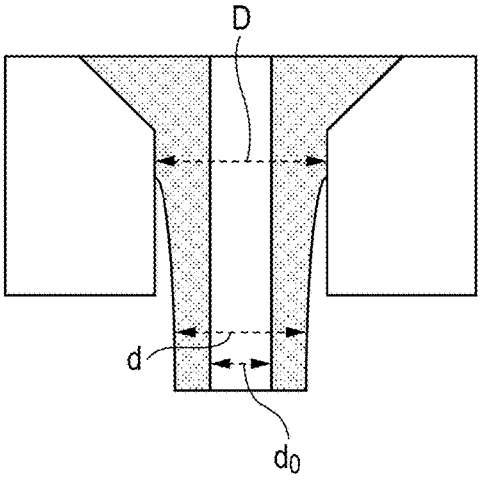

The schematic view of the vicinity of the extrusion port of the crosshead is shown in FIG. 4B. When the inner diameter of the dice of the extrusion port of the crosshead is taken as D; the outer diameter of the unvulcanized rubber roller is taken as d; and the outer diameter of the mandrel is taken as $d_0$, "$(d-d_0)/(D-d_0)$" equivalent to "(thickness of layer of unvulcanized rubber composition)/(gap of extrusion port)" is defined as a taking-over rate (%).

The value means the same thickness of the unvulcanized rubber composition layer as that of the gap of the extrusion port when the taking-over rate is 100%. As the taking-over rate is smaller, the unvulcanized rubber is molded while it is more largely extended in the longitudinal direction of the mandrel. A large concave portion is formed in the surface of the layer (elastic layer) of the unvulcanized rubber composition. When the taking-over rate is preferably 90% or less, and more preferably 80% or more, a concave portion having a moderate size can be formed. In general molding, the unvulcanized rubber composition discharged from the extrusion port is usually shrunk by die swell to provide a taking-over rate of 100% or more.

The taking-over rate can be adjusted by changing a relative ratio of a mandrel feeding speed provided by the conveying roller 45 of the mandrel 41 to the feeding speed of the unvulcanized rubber composition from the cylinder 46. At this time, the feeding speed of the unvulcanized rubber composition 42 to the crosshead 44 from the cylinder 46 is set constant. The thickness of the layer of the unvulcanized rubber composition 42 is determined by the ratio of the feeding speed of the mandrel 41 to the feeding speed of the unvulcanized rubber composition 42.

The unvulcanized rubber composition is preferably molded in a so-called crown shape having an outer diameter (thickness) of the central portion in the longitudinal direction of each mandrel 41 larger than that of an end. Thus, the unvulcanized rubber roller 43 can be obtained.

[Step 3]

A step 3 is a step of heating the unvulcanized rubber roller to vulcanize the rubber, thereby obtaining the vulcanized rubber roller. The step 3 is carried out after the step 2 when vulcanization is required. The unvulcanized rubber roller is vulcanized by heating, and specific examples of a heat treatment method include hot-air oven heating in a gear oven, heating vulcanization using far-infrared rays, and water vapor heating using a vulcanization can. Among these, hot-air oven heating and far-infrared heating are suitable for continuous production, which are preferable. In a case where no cross-linking is required such as a case where the surface layer is formed using the thermoplastic elastomer, the unvulcanized rubber roller made of the thermoplastic elastomer can be used as it is in place of the vulcanized rubber roller while the unvulcanized rubber roller is suitably cooled, for example.

The vulcanized rubber composition of both the ends of the vulcanized rubber roller is removed in the next step, to complete the vulcanized rubber roller. Therefore, both the ends of the mandrel of the completed vulcanized rubber roller are exposed.

In the case of the electrophotographic apparatus which holds the exposed portions of both the ends of the mandrel, the load of the end of the charging roller is increased. In the case of the electro-conductive rubber composition having electronic conductivity, the resistance of the end is increased by deterioration caused by a load, which may be apt to cause image defect which is in the form of a horizontal stripe. In the case of providing a crown shape in the manufacturing method, the taking-over rate at the end is smaller than that of the central portion of the roller, so that a larger concave portion is formed in the end. Therefore, a dirt scattering effect provided by the local electric field of the end is particularly high. The ratio Le/Lm of the average value Lm of the distances of the separation regions in the central portion of the roller to the average value Le of the distances of the separation regions in the end of the roller is preferably 1.1 or more and 1.3 or less. The average value of the distances of the separation regions is calculated by values obtained by measuring 100 concave portions in the vicinity of the center in the axis direction of the roller, and 100 concave portions (50 concave portions in each end) in the both ends of the roller.

The elastic layer may be irradiated with ultraviolet rays or electron beams to subject the elastic layer to a surface treatment.

Another examples of the method for manufacturing the elastic layer include the following method [2].

Method [2]

First, an unvulcanized rubber composition containing a foaming agent is prepared. An electro-conductive substrate (mandrel) and the unvulcanized rubber composition are supplied to a crosshead extrusion-molding machine, where the unvulcanized rubber is subjected to heating vulcanization by extrusion molding, and the foaming agent is thermally decomposed (foamed), to obtain a vulcanized rubber roller. The surface of the vulcanized rubber roller is polished, and a concave portion due to a hole produced by foaming is exposed to the surface of a vulcanized rubber layer. A spherical particle made of a thermoplastic resin having a diameter shorter than the long diameter of the concave portion is applied to the concave portion. Then, the spherical particle is heated at a temperature higher than the melting point of the spherical particle made of a thermoplastic resin to cause the spherical particle to adhere tightly to the concave portion.

Compared with the method [2], a portion with which a concave portion and the peripheral wall of a convex portion are not in contact is oriented in the longitudinal direction of a charging member in the elastic layer obtained by the method [1] extruding while controlling an elongation at break and a taking-over rate. Therefore, a dirt scattering effect provided by a local electric field is high, which is preferable.

(Formation of Surface Layer)

The charging roller according to the present invention can be obtained by forming the surface layer on the outer circumference of the elastic roller (unvulcanized rubber roller or vulcanized rubber roller) manufactured by the above method. Examples of the method for forming the surface layer include the coating methods such as the electrostatic spray coating, dipping coating, and ring coating as described above.

<Electrophotographic Image Forming Apparatus>

An electrophotographic image forming apparatus includes an image bearing member, a charging apparatus which charges the image bearing member, a developing apparatus which develops an electrostatic latent image formed on the image bearing member by use of a developer, and a transfer member which transfers the developer supported by the image bearing member to a transfer medium, wherein the developing apparatus includes the charging member according to the present invention.

Figure 5:
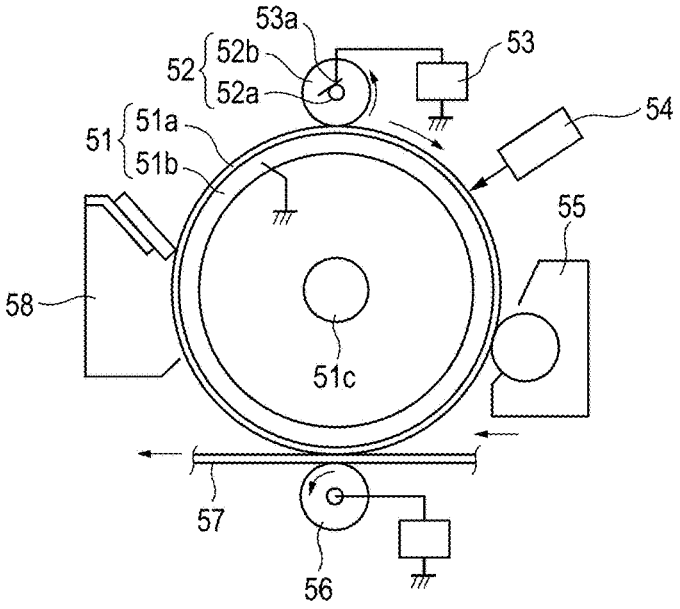
FIG. 5 is a configuration diagram schematically showing an example of an electrophotographic apparatus having a charging member.
Figure 6A:
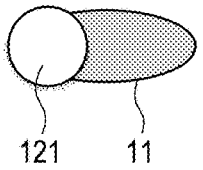
FIGS. 6A, 6B, 6C and 6D are schematic views showing an example of the shape of a concave portion.
Figure 6B:
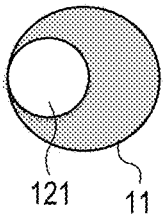
Figure 6C:
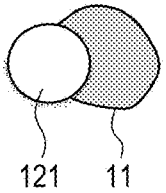
Figure 6D:
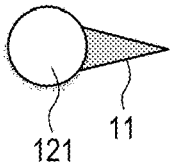

An electrophotographic image forming process will be described using FIG. 5. An electrophotographic photosensitive member (photosensitive member) 51 as the charging member includes a conductive support 51*b* and a photosensitive layer 51*a* formed on the support 51*b*, and has a cylindrical shape. The electrophotographic photosensitive member is driven at a predetermined peripheral velocity in a clockwise fashion centering on an axis 51*c* in FIG. 5.

A charging member (charging roller) 52 is disposed in contact with a photosensitive member 51, and charges the photosensitive member at a predetermined potential. The charging roller 52 includes an electro-conductive substrate 52*a* and a surface layer 52*b* formed thereon. Both the ends of the electro-conductive substrate 52*a* are pressed to the photosensitive member 51 by a pressing unit (not shown), and the charging roller is rotated according to the photosensitive member 51, or rotated with a given velocity difference between the charging roller and the photosensitive member 51. The photosensitive member 51 is charged at a predetermined potential by a predetermined direct-current voltage applied to the electro-conductive substrate 52*a* via a sliding electrode 53*a* from a power supply 53.

An electrostatic latent image corresponding to the objective image information is then formed on the circumferential face of the charged photosensitive member 51 by an exposing unit 54. The electrostatic latent image is then successively visualized as a toner image by a developing member 55. The toner image is successively transferred onto a transfer material 57. The transfer material 57 is conveyed from a paper feeding unit not shown to a transfer portion present between the photosensitive member 51 and the transferring unit 56 at appropriate timing in synchronization with the rotation of the photosensitive member 51. The transferring unit 56 is a transferring roller, and the toner image formed on the photosensitive member 51 side is transferred onto the transfer material 57 by charging the transfer material 57 to polarity opposite to the polarity of the toner from a rear side of the transfer material 57. The transfer material 57 having the toner image transferred onto the surface thereof is separated from the photosensitive member 51 to be conveyed to a fixing unit not shown for fixing the toner image, and is output as an image formed material. Toner or the like remaining on the surface of the photosensitive member 51 after the image is transferred is removed by a cleaning unit 58 provided with a cleaning member typified by an elastic blade. The cleaned peripheral surface of the photosensitive member 51 is subjected to an electrophotographic image forming process as the next cycle.

<Process Cartridge>

A process cartridge is configured to be detachably attachable to a body of an electrophotographic image forming apparatus, the process cartridge including an image bearing member and a charging member disposed in contact with the image bearing member, wherein the charging member is the charging member according to the present invention.

One aspect of the present invention can provide a charging member which can suppress the adhesion of dirt such as a massive external additive or toner to a surface. Another aspect of the present invention can provide a process cartridge and an electrophotographic image forming apparatus which can form a high-quality electrophotographic image.

EXAMPLES

Hereinafter, the present invention will be described in more detail based on Examples, which do not limit the invention. Commercially available highly pure products were used as reagents or the like not particularly specified unless otherwise mentioned. A charging roller was produced in each Example. In the following description, "part(s)" means "part(s) by mass". Materials and compositions used for elastic layers and surface layers used in Examples and Comparative Examples were summarized in Tables 3 to 6.

Particles of the following Table 1 were prepared as particles contained in the elastic layer. The volume resistivity of each of these particles was measured by the method as described above using a powder resistivity measuring device (trade name: powder resistance measurement system MCP-PD51 type, manufactured by Mitsubishi Chemical Analytech Co., Ltd.). A particle having the volume resistivity is $10^{11}$ Ωcm or more is determined as "insulating". A particle having the volume resistivity is $10^{10}$ Ωcm or less is determined as "electro-conductive". The determination results are also shown in Table 1.

TABLE 1

| Particle No. | Particles | Evaluation of electro-conductivity |
|---|---|---|
| 1 | Polyurethane particle, average particle size 4 (μm) | Insulating |
| 2 | Polyurethane article, average particle size 6 (μm) (Art Pearl TK-800T, Negami chemical industrial co., ltd.) | Insulating |
| 3 | Polyurethane particle, average particle size 9 (μm) (DAIMICBEAZ UCN-5090D, Dainichi Seika Color & Chemical Mfg. Co., Ltd.) | Insulating |
| 4 | Polyurethane particle, average particle size 15 (μm) (DAIMICBEAZ UCN-5150D, Dainichi Seika Color & Chemical Mfg. Co., Ltd.) | Insulating |
| 5 | Polyurethane particle, average particle size 20 (μm) (Gran Pearl GU-2000P, Aica Kogyo Company, Limited) | Insulating |
| 6 | Polyurethane particle, average particle size 40 (μm) | Insulating |
| 7 | PMMA particle, average particle size 8 (μm) (Ganz Pearl GM0801, Aica Kogyo Company, Limited) | Insulating |
| 8 | Polyethylene particle, average particle size 9 (μm) (Miperon PM200, Mitsui Chemicals, Inc.) | Insulating |
| 9 | Spherical Silica particle, average particle size 10 (μm) (FB-12D, DENKI KAGAKU KOGYO K.K.) | Insulating |
| 10 | Spherical carbon particle, average particle size 8 (μm) (Glassy carbon, Tokai Carbon Co., Ltd.) | Electro-conductive |

"PMMA" of "PMMA particle" means polymethylmethacrylate in Table 1.

Polyurethane particles according to particle No. 1 and particle No. 6 were prepared as follows.

<Preparation of Particle No. 1>

Three parts by mass of polyisocyanate of NCO %=12.3 (trade name: Duranate 24A, manufactured by Asahi Chemical Industry Co., Ltd.) was added to 100 parts by mass of polydiethylene-butylene adipate having a hydroxyl value of 45, followed by uniformly mixing to obtain a mixture. The mixture was added to a dispersion in which 5 parts by mass of fluorine treatment silica was dispersed in 300 parts by mass of a fluoride oil (trade name: Galden HT135, manufactured by SOLVAY Corporation), followed by performing a supersonic treatment for 20 minutes, thereby obtaining an emulsified liquid. The emulsified liquid was heated to 90° C., and stirred at 400 rpm for 8 hours, to obtain a polyurethane gel particle dispersion liquid. The dispersion liquid was vacuum-dried to produce a polyurethane particle No. 1 having a particle diameter of 4 μm.

<Preparation of Particle No. 6>

A polyurethane particle No. 6 having a particle diameter of 40 μm was prepared in the same manner as in the particle No. 1 except that the amount of addition of polyisocyanate was changed to 32.4 parts by mass from 3 parts by mass.

<Production of Elastic Roller>

<Production of Elastic Roller No. 1>

1. Preparation and Evaluation of Unvulcanized Rubber Composition No. 1 for Elastic Layer Materials shown in Table 2 were mixed to obtain an A-kneading rubber composition. A 6-liter pressurized kneader (product name: TD6-15MDX, manufactured by Toshin Co., Ltd.) was used for a mixer. Mixing was performed under conditions of a filling rate of 70% by volume, the number of rotations of a blade of 30 rpm, and a time of 16 minutes.

TABLE 2

| Materials | Parts by mass |
|---|---|
| NBR (trade name: JSR N230SL, manufactured by JSR, Inc.) | 100 |
| Zinc stearate | 1 |
| Zinc oxide | 5 |
| Calcium carbonate (trade name: super #1700, manufactured by Maruo Calcium Co., Ltd.) | 25 |
| Carbon black (trade name: Tokablack #7270SB, manufactured by Tokai Carbon Co., Ltd.) | 50 |

Then, the A-kneading rubber composition and materials shown in Table 3 were mixed, to obtain a B-kneading rubber composition. An open roll having a roll diameter of 12 inches (0.30 m) was used for a mixer. Mixing was performed under the following conditions: the right and left portions were cut 20 times in total at a front-roll rotation speed of 10 rpm, a rear-roll rotation speed of 8 rpm, and a roll gap of 2 mm. Thereafter, the roll gap was changed to 0.5 mm. The mixture was subjected to tight milling 10 times. Both TS and DM in Table 3 are vulcanizing accelerators.

TABLE 3

| Materials | Parts by mass |
|---|---|
| Sulfur | 1 |
| TS (trade name: Nocceler TS, manufactured by Ouchi Shinko Chemical Industrial Co., Ltd.) | 1 |
| DM (trade name: Nocceler DM, manufactured by Ouchi Shinko Chemical Industrial Co., Ltd.) | 1 |

Furthermore, the B-kneading rubber composition and 20 parts by mass of a "particle No. 3" were mixed, to obtain an "unvulcanized rubber composition No. 1". An open roll having a roll diameter of 12 inches (0.30 m) was used for a mixer. Mixing was performed under the following conditions: the right and left portions were cut 20 times in total at a front-roll rotation speed of 8 rpm, a rear-roll rotation speed of 10 rpm, and a roll gap of 2 mm. Thereafter, the roll gap was changed to 0.5 mm. The mixture was subjected to tight milling 10 times.

[Evaluation 1] Measurement of Elongation at Break

An unvulcanized rubber sheet was molded in a 2-mm-thick rectangular mold using the unvulcanized rubber composition No. 1 for the elastic layer. Molding was performed under conditions of a temperature of 80° C. and a pressure of 10 MPa. The elongation at break of the unvulcanized rubber sheet was measured according to JIS K-6251 using a tensilon universal testing machine RTG-1225 (trade name, manufactured by Orientec Co., Ltd.) as a tension testing machine. At this time, the unvulcanized rubber sheet was used as a test piece having a shape of a dumbbell No. 1 under an environment of a tension speed of 500 mm/min, a temperature of 23° C., and relative humidity of 50%. The elongation at break was 72%.

2. Formation of Adhesion Layer to Electro-Conductive Mandrel

An electro-conductive vulcanization adhesive (trade name: Metaloc U-20, manufactured by Toyo Kagaku Kenkyusho Co., Ltd.) was applied to the outer circumference of an axially center portion with a length of 222 mm of a cylindrical electro-conductive mandrel (made of steel and having a nickel-plated surface) having a diameter of 6 mm and a length of 252 mm, and the resultant was dried at 80° C. for 30 minutes. Thus, an adhesion layer was formed on the surface of the electro-conductive mandrel.

was 8.9 mm; the outer diameter of the center in the axis direction of the unvulcanized rubber roller was 8.6 mm; and the outer diameter of an end at a position separated by 90 mm from the center was 8.4 mm. Then, the unvulcanized rubber roller was heated at a temperature of 160° C. in an electric furnace for 40 minutes, to vulcanize the layer of the unvulcanized rubber composition, thereby obtaining a vulcanized rubber roller. Both the ends of the vulcanized rubber roller were cut, and the length thereof in the axis direction was set to 232 mm. Thus, an elastic roller No. 1 was produced.

<Elastic Rollers No. 2 to 17>

Unvulcanized rubber compositions No. 2 to 17 having compositions described in Table 4 were prepared. Each unvulcanized rubber composition was subjected to Evaluation 1. The results are also shown in Table 4.

Then, elastic rollers No. 2 to 17 were produced in the same manner as in the elastic roller No. 1 except that the unvulcanized rubber compositions No. 2 to 17 were used and the taking-over rate was changed as shown in Table 5.

TABLE 4

| | Unvulcanized rubber composition No. for elastic layer | | | | | | | | | | | | | | | | |
|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 |
| NBR ("N230SL", manufactured by JSR, Inc.) | 100 | 100 | 100 | 100 | 100 | 100 | 100 | 100 | 100 | 100 | 100 | 100 | 100 | 100 | 100 | 100 | |
| Hydrin rubber ("Epion 301" manufactured by Osaka Soda Co., Ltd.) | | | | | | | | | | | | | | | | | 100 |
| Carbon black ("Tokablack #7270SB", manufactured by Tokai Carbon Co., Ltd.) | 50 | 50 | 50 | 50 | 50 | 50 | 50 | 50 | 50 | 50 | 50 | 50 | 50 | 50 | 50 | 50 | 50 |
| Zinc oxide | 5 | 5 | 5 | 5 | 5 | 5 | 5 | 5 | 5 | 5 | 5 | 5 | 5 | 5 | 5 | 5 | 5 |
| Zinc stearate | 1 | 1 | 1 | 1 | 1 | 1 | 1 | 1 | 1 | 1 | 1 | 1 | 1 | 1 | 1 | 1 | 1 |
| Calcium carbonate ("Super #1700", Maruo Calcium Co., Ltd.) | 25 | 75 | 50 | 25 | 25 | 25 | 25 | 25 | 25 | 25 | 25 | 25 | 25 | 25 | 25 | 25 | 25 |
| Sulfur | 1 | 1 | 1 | 1 | 1 | 1 | 1 | 1 | 1 | 1 | 1 | 1 | 1 | 1 | 1 | 1 | 1 |
| TS (Nocceler TS, Ouchi Shink Chemical Industrial Co., Ltd.) | 1 | 1 | 1 | 1 | 1 | 1 | 1 | 1 | 1 | 1 | 1 | 1 | 1 | 1 | 1 | 1 | 1 |
| DM (Nocceler DM, Ouchi Shinko Chemical Industrial Co., Ltd.) | 1 | 1 | 1 | 1 | 1 | 1 | 1 | 1 | 1 | 1 | 1 | 1 | 1 | 1 | 1 | 1 | 1 |
| Particle No. 1 | | | | | | | | 20 | | | | | | | | | |
| Particle No. 2 | | | | | | | | | 20 | | | | | | | | |
| Particle No. 3 | 20 | 20 | 20 | 20 | 20 | 20 | | | | | | | | | | | 20 |
| Particle No. 4 | | | | | | | | | | 20 | | | | | | | |
| Particle No. 5 | | | | | | | | | | | 20 | | | | | | |
| Particle No. 6 | | | | | | | | | | | | 20 | | | | | |
| Particle No. 7 | | | | | | | | | | | | | 20 | | | | |
| Particle No. 8 | | | | | | | | | | | | | | 20 | | | |
| Particle No. 9 | | | | | | | | | | | | | | | 20 | | |
| Particle No. 10 | | | | | | | | | | | | | | | | 20 | |
| Evaluation 1 (%) | 72 | 55 | 64 | 71 | 72 | 72 | 72 | 75 | 74 | 70 | 68 | 65 | 70 | 71 | 71 | 72 | 110 |

3. Molding of Vulcanized Rubber Layer

The outer circumference of the mandrel having the adhesion layer was covered with the unvulcanized rubber composition No. 1 for the elastic layer using a crosshead extrusion-molding machine, to obtain a crown-shaped unvulcanized rubber roller. Molding was performed at a molding temperature of 100° C. and a screw rotation speed of 10 rpm while the feeding speed of the mandrel was changed. The taking-over rate averaged in the axis direction of the unvulcanized rubber roller was set to 85%. The dice inner diameter of the crosshead extrusion-molding machine

TABLE 5

| Elastic roller No. | Unvulcanized rubber composition No. | Taking-over rate (%) | Elastic roller No. | Unvulcanized rubber composition No. | Taking-over rate (%) |
|---|---|---|---|---|---|
| 1 | 1 | 88 | 10 | 10 | 85 |
| 2 | 2 | 104 | 11 | 11 | 83 |
| 3 | 3 | 90 | 12 | 12 | 81 |
| 4 | 4 | 89 | 13 | 13 | 87 |
| 5 | 5 | 89 | 14 | 14 | 90 |

TABLE 5-continued

| Elastic roller No. | Unvulcanized rubber composition No. | Taking-over rate (%) | Elastic roller No. | Unvulcanized rubber composition No. | Taking-over rate (%) |
|---|---|---|---|---|---|
| 6 | 6 | 84 | 15 | 15 | 89 |
| 7 | 7 | 90 | 16 | 16 | 88 |
| 8 | 8 | 88 | 17 | 17 | 95 |
| 9 | 9 | 87 | | | |

<Preparation of Coating Liquid for Forming Surface Layer>

1. Materials described in Table 6 were prepared as materials used for preparing a coating liquid for forming a surface layer.

TABLE 6

| | |
|---|---|
| A-1 | Polybutadiene polyol (trade name: G2000, manufactured by Nippon Soda Co., Ltd.) |
| A-2 | Polyester polyol (trade name: P2010, manufactured by Kuraray Co., Ltd.) |
| A-3 | Polycarbonate-based polyol (trade name: T5652, manufactured by Asahi Chemical Chemicals) |
| A-4 | Polyether polyol (trade name: Excenol 3020, manufactured by Asahi Glass Co., Ltd.) |
| A-5 | Polycaprolactone-base polyol (trade name: Placcel 220N, manufactured by Daicel (Former: Daicel Chemical Industries)) |
| A-6 | Acrylic polyol (trade name: DC2016, manufactured by Daicel (Former: Daicel Chemical Industries)) |
| B-1 | Polybutadiene polyol/polymeric MDI (trade name: G2000, manufactured by Idemitsu Kosan Co., Ltd./ trade name: Millionate MR200, manufactured by Nippon Polyurethane Industry Co., Ltd.) |
| B-2 | Polyester polyol/polymeric MDI (trade name: P3010, manufactured by Kuraray Co., Ltd.: Millionate MR200, manufactured by Nippon Polyurethane Industry Co., Ltd.) |
| B-3 | Polycarbonate-based polyol/polymeric MDI (trade name: T5652, manufactured by Asahi Chemical Chemicals/ trade name: Millionate MR200, manufactured by Nippon Polyurethane Industry Co., Ltd.) |
| B-4 | Polypropylene glycol-based polyol/polymeric MDI (trade name: Excenol 1030, manufactured by Asahi Chemical Co., Ltd./trade name: Millionate MR200, manufactured by Nippon Polyurethane Industry Co., Ltd. |
| B-5 | Monomeric MDI (trade name: Millionate MT, manufactured by Nippon Polyurethane Industry Co., Ltd.) |
| B-6 | Isocyanate A/isocyanate B = 4/3 (trade name: Vestanat B1370, manufactured by Degussa/trade name: Duranate TPA-B80E, manufactured by Asahi Chemical Chemicals) |
| C-1 | Polybutadiene (trade name: B2000, manufactured by Nippon Soda Co., Ltd.) |
| C-2 | Hydrogenated polybutadiene (trade name: BI2000, manufactured by Nippon Soda Co., Ltd.) |
| C-3 | Polyisoprene (trade name: LIR30, manufactured by Kuraray Co., Ltd.) |
| C-4 | Hydrogenated polyisoprene (trade name: LIR200, manufactured by Kuraray Co., Ltd.) |
| C-5 | Polyisobutylene (molecular weight: 500000, manufactured by Sigma-Aldrich) |
| C-6 | Polymethylmethacrylate (Molecular weight 10000, manufactured by Sigma-Aldrich) |
| D-1 | Polybutadiene methacrylate (trade name: EMA3000, manufactured by Nippon Soda Co., Ltd.) |
| D-2 | Polyisoprene-based acrylate (trade name: UC102, manufactured by Kuraray Co., Ltd.) |
| E-1 | Polymerization initiator (trade name: IRGACURE184, manufactured by Toyotsu Chemiplas Corporation) |

2. Preparation of Coating Liquid for Forming Surface Layer

<Preparation of Coating Liquid No. 1>

Under a nitrogen atmosphere, 100 parts by mass of A-1 was gradually added dropwise to 27 parts by mass of polymeric MDI (polymethylene polyphenyl polyisocyanate) (trade name: Millionate MR200, manufactured by Tosoh Corporation) in a reaction vessel, while the internal temperature of the reaction vessel was kept at 65° C. After the completion of the dropwise addition, the mixture was reacted at 65° C. for 2 hours. The obtained reaction mixture was cooled to room temperature, to obtain an isocyanate-terminated prepolymer B-1 having an isocyanate group content of 4.3% by mass.

Fifty-seven parts by mass of the obtained isocyanate-terminated prepolymer B-1 and 43 parts by mass of A-1 were added to methyl ethyl ketone (MEK) so that a solid content was adjusted to 15% by mass, to obtain a coating liquid No. 1.

<Preparation of Coating Liquid No. 2>

An isocyanate-terminated prepolymer B-2 was obtained in the same manner as in the isocyanate-terminated prepolymer B-1 except that A-1 used for preparing the isocyanate-terminated prepolymer B-1 was changed to polyester polyol (trade name: P3010, manufactured by Kuraray Co., Ltd.).

Fifty-five parts by mass of the obtained isocyanate-terminated prepolymer B-2 and 45 parts by mass of A-2 were added in methyl ethyl ketone (MEK) so that a solid content was adjusted to 15% by mass, to obtain a coating liquid No. 2.

<Preparation of Coating Liquid No. 3>

An isocyanate-terminated prepolymer B-3 was obtained in the same manner as in the isocyanate-terminated prepolymer B-1 except that A-1 used for preparing the isocyanate-terminated prepolymer B-1 was changed to polycarbonate-based polyol (trade name: T5652, manufactured by Asahi Chemical Chemicals).

Fifty-four parts by mass of the obtained isocyanate-terminated prepolymer B-3 and 46 parts by mass of A-3 were added in methyl ethyl ketone (MEK) so that a solid content was adjusted to 15% by mass, to obtain a coating liquid No. 3.

<Preparation of Coating Liquid No. 4>

An isocyanate-terminated prepolymer B-4 was obtained in the same manner as in the isocyanate-terminated prepolymer B-1 except that A-1 used for preparing the isocyanate-terminated prepolymer B-1 was changed to polypropylene glycol-based polyol (trade name: Excenol 1030, manufactured by Asahi Chemical Chemicals).

Fifty-nine parts by mass of the obtained isocyanate-terminated prepolymer B-4 and 41 parts by mass of A-4 were added in methyl ethyl ketone (MEK) so that a solid content was adjusted to 15% by mass, to obtain a coating liquid No. 4.

<Preparation of Coating Liquids No. 5, 7-1 to 7-6, 8 to 14>

Coating liquids No. 5, 7-1 to 7-5, and 8 to 14 were obtained in the same manner as in the coating liquid No. 1 except that compositions shown in the following Table 7 were set.

TABLE 7

| | | Polyol (A) | Isocyanate (B) | A/B amount of addition (parts by mass) | Polymer (C) | (Meth)acrylate (D) | Polymerization initiator (E) | D/E amount of addition (parts by mass) | Methyl ethyl ketone dilution rate (% by mass) |
|---|---|---|---|---|---|---|---|---|---|
| Coating liquid No. | 1 | A-1 | B-1 | 43/57 | — | — | — | — | 15 |
| | 2 | A-2 | B-2 | 45/55 | — | — | — | — | 15 |
| | 3 | A-3 | B-3 | 46/54 | — | — | — | — | 15 |
| | 4 | A-4 | B-4 | 41/59 | — | — | — | — | 15 |
| | 5 | A-5 | B-5 | 45/55 | — | — | — | — | 15 |
| | 7-1 | — | — | — | C-1 | — | — | — | 5 |
| | 7-2 | — | — | — | C-1 | — | — | — | 8 |
| | 7-3 | — | — | — | C-1 | — | — | — | 10 |
| | 7-4 | — | — | — | C-1 | — | — | — | 15 |
| | 7-5 | — | — | — | C-1 | — | — | — | 50 |
| | 7-6 | — | — | — | C-1 | — | — | — | 52 |
| | 8 | — | — | — | C-2 | — | — | — | 15 |
| | 9 | — | — | — | C-3 | — | — | — | 15 |
| | 10 | — | — | — | C-4 | — | — | — | 15 |
| | 11 | — | — | — | C-5 | — | — | — | 15 |
| | 12 | — | — | — | C-6 | — | — | — | 15 |
| | 13 | — | — | — | — | D-1 | E-1 | 100/5 | 15 |
| | 14 | — | — | — | — | D-2 | E-1 | 100/5 | 15 |

<Preparation of Coating Liquid No. 6>

Materials shown in Table 8 were mixed to prepare a mixed liquid. Carbon black is a conductive particle. Both the mixed liquid and glass beads having an average particle diameter of 0.8 mm were placed in a glass bottle, and dispersed using a paint shaker disperser for 60 hours, to prepare a coating liquid No. 6 for a covering layer.

TABLE 8

| Materials | Parts by mass |
|---|---|
| Polyol (trade name "Placcel DC2016": manufactured by Daicel Chemical Industries, Ltd. (solid content: 70% by mass)) | 100 |
| IPDI (isophorone diisocyanate): Block isocyanate IPDI (trade name "Vestanat B1370": manufactured by Degussa Huls) | 22.5 |
| HDI (Hexamethylene diisocyanate): Block isocyanate HDI (trade name "Duranate TPA-B80E": manufactured by Asahi Chemical Industry Co., Ltd.) | 33.6 |
| Carbon black | 30 (equivalent to 10% by volume) |
| Methyl isobutyl ketone (MIBK) | 500 |

Example 1

1. Formation of Surface Layer

The coating liquid No. 7-4 was applied to the outer circumference of the elastic roller No. 1 using a circular coating head. The relative moving speed of the elastic roller No. 1 to the circular coating head was set to 85 mm/s; the discharge speed of the coating liquid from a nozzle of the circular coating head was set to 0.120 mL/s; and the total discharge amount of the coating liquid No. 1 was set to 0.375 mL.

The coated film of the coating liquid No. 1 of the outer circumference portion of the elastic roller No. 1 was irradiated with ultraviolet rays having a wavelength of 254 nm at a cumulative light quantity of 9000 mJ/cm$^2$, to cure the coated film, thereby forming the surface layer to produce the charging roller No. 1. A low-pressure mercury lamp (manufactured by Toshiba Lighting & Technology Corp.) was used for the irradiation of ultraviolet rays.

The charging roller No. 1 was subjected to the following Evaluations 2 to 8.

[Evaluation 2] Measurement of Distance L of Separation Region

The distance L of the separation region was measured by the following method. First, the height image of the surface of the charging roller was measured by a confocal microscope (trade name: OPTELICS HYBRID, manufactured by Lasertec Corporation). Observation was performed under conditions of an objective lens of 50 times, the number of pixels of 1024 pixels, and a height resolution of 0.1 μm, and a value obtained by subjecting the obtained image to plane correction on a secondary curved surface was taken as the value of a height.

Then, using image analysis software (trade name: "Image-Pro Plus", manufactured by Planetron Co), the distance L of the separation region of the outer edge of the insulating particle and the outer edge of the concave portion was calculated. First, the height image was binarized with the average value of the heights taken as a threshold value. Next, the concave portion of a portion lower than the average value of the heights was automatically extracted according to count/size. A normal line was drawn from the outer edge of the insulating particle being in contact with the concave portion, and the distance of a portion having the longest distance with the outer edge of the concave portion was measured. Such operation was performed on 100 concave portions in the vicinity of the center in the axis direction of the roller, and 100 concave portions (50 concave portions in each end) in the vicinity of positions separated by 90 mm in the directions of both the ends from the center in the order from the largest area for the concave portion of a portion lower than the average value (average line 23 of FIG. 2C) of the extracted heights. The average value of the extracted numerical values was taken as the distance L of the separation region. When the distance is equal to or more than double for the average particle size Dm of the insulating particles, an excellent effect of the present invention can be exhibited.

The distance L of the separation region was 25 μm. The ratio Le/Lm of the average value Lm of the distances of the separation regions in the central portion to the average value Le of the distances of the separation regions in the end was 1.2.

[Evaluation 3] Measurement of Height Hp of Convex Portion and Ratio Dr/L

Hp and the ratio Dr/L were measured by the following method. First, the height image of the surface of the charging roller was measured by a confocal microscope (trade name: OPTELICS HYBRID, manufactured by Lasertec Corporation). Observation was performed under conditions of an objective lens of 50 times, the number of pixels of 1024 pixels, and a height resolution of 0.1 μm, and a value obtained by subjecting the obtained image to plane correction on a secondary curved surface was taken as the value of a height.

From the height image, the cross-section profile of the outer circumference portion of the concave portion formed around the convex portion of the insulating particle was extracted, and a distance between the average value of the heights (average line 23 of FIG. 2C) and the peak of the convex portion was obtained. A value obtained by averaging the 100 values (100 convex portions) was taken as the height Hp of the convex portion. Similarly, a distance between the average value of the heights (average line 23 of FIG. 2C) and the bottom of the concave portion was obtained, and the distance was taken as the depth Dr value of the concave portion. A value Dr/L obtained by dividing the depth Dr by the distance L of the separation region was obtained. A value obtained by averaging the 100 values (100 concave portions) was taken as a ratio (percentage) of the depth of the concave portion to the distance of a portion in which the outer edge of the insulating particle and the outer edge of the concave portion were separated from each other. Measurement was performed on 100 concave portions in the vicinity of the center in the axis direction of the roller, and 100 concave portions (50 concave portions in each end) in the vicinity of positions separated by 90 mm in the directions of both the ends from the center. The height Hp of the convex portion was 4 μm. The ratio Dr/L of the depth Dr of the concave portion to the distance L of the separation region was 23%.

[Evaluation 4] Measurement of Orientation Angle of Concave Portion

In order to measure the orientations of the position of the center of gravity of the gap formed by separation of each of the insulating particles and each of the concave portions, and position of the center of gravity of each of the insulating particles, the image of a transmission electron microscope (hereinafter, abbreviated to "TEM") was obtained. As a sample for TEM observation, a thin piece obtained by cutting the vicinity of the surface of the surface layer in parallel with the surface so that the concave portion was cut was used. The thin piece was prepared by an ultrathin slice method. A cutting apparatus is Clio Microtome (trade name "Leica EM FCS", manufactured by Leica Mikrosysteme GmbH). A cutting temperature was set to −100° C. As TEM, H-7100FA (trade name) manufactured by Hitachi High-Technologies Corp. was used. An accelerating voltage was set to 100 kV, and a viewing field was set to a bright viewing field. An image obtained by observing the thin piece with TEM was captured so that each of the concave portion, the insulating particle, and the electro-conductive rubber composition had a contrast difference. An image formed by ternarizing the concave portion, the insulating particle, and the electro-conductive rubber composition by image processing was used as necessary.

The X and Y coordinates of the center of gravity of each gap formed by separation of each of the insulating particles and each of the concave portions, and the X and Y coordinates of the center of gravity of each of the insulating particles which exists in the concave portion were measured by the count/size function of image analysis software (trade name: "Image-Pro Plus", manufactured by Planetron Co). An acute angle between a direction in which the coordinates of the center of gravity of each gap formed by separation of each of the insulating particles and each of the concave portions and center of gravity of each of the insulating particles are connected and the axis direction of the roller was measured for 100 points (100 concave portions), to obtain the orientation angle of the concave portion. The orientation angle of the concave portion was 0 degree.

[Evaluation 5] Measurement of Film Thickness of Surface Layer

Measurement was performed in a total of nine places: three places obtained by equally splitting the axis direction of the surface layer into three, and three places obtained by equally splitting a circumferential direction in each of the three places. In each measurement place, the cross-section of the surface layer was cut out with a sharp knife, and the obtained sample was observed under an optical microscope or an electron microscope. The maximum and minimum values of the film thickness in one viewing field were measured in five viewing fields per cross-section of one place, to obtain a total of 45 measured values. The maximum value $T_{max}$ of the film thickness was 4.3 μm, and the minimum value $T_{min}$ was 1.4 μm.

[Evaluation 6] Measurement of Volume Resistivity of Surface Layer

The volume resistivity of the surface layer was measured using an atomic force microscope (AFM) (Q-scope 250, Quesant Instrument Corp.) at the electro-conductive mode. First, the surface layer of the charging roller was cut into a sheet of 2 mm in width and 2 mm in length using a manipulator, and platinum was vapor-deposited on one surface of the surface layer. Next, a direct-current power supply (6614C, Agilent Technologies, Inc.) was connected to the platinum-vapor-deposited surface and allowed to apply 10 V thereto. A free end of a cantilever was contacted with the other surface of the surface layer to obtain a current image through the body of AFM. One hundred places in the whole surface layer were randomly measured, and the "volume resistivity" was calculated from the average current value of top 10 places of low current values, and the average value of the film thicknesses of the surface layers measured in the above "Evaluation 6". The volume resistivity was $7.5\times10^{15}$ Ωcm.

Measurement conditions are shown below.

Measurement mode: contact

Cantilever: CSC17

Measurement range: 10 nm×10 nm

Scan rate: 4 Hz

Applied voltage: 10 V

[Evaluation 7] Dirt Evaluation (cleaner)

A laser beam printer (trade name: HP LaserJet P1505 Printer, manufactured by HP Inc.) was prepared as an electrophotographic apparatus. The laser beam printer is capable of outputting A4 size paper in the longitudinal direction. The laser printer has a printing speed of 23 sheets/min. and an image resolution of 600 dpi. An accompanying charging roller was detached from a process cartridge (trade name: "HP 36A (CB436A)", manufactured by HP Inc.) for the laser beam printer, and the charging roller No. 1 was incorporated as a charging roller into the process cartridge The process cartridge was loaded in the laser beam printer. At this time, the cartridge was equipped with a cleaner blade having 2-μm chipping at the center.

The laser beam printer was used to form 5 halftone images (horizontal lines having a width of 1 dot were drawn in a direction perpendicular to the rotational direction of the photosensitive member at 2 dots interval) under a low-temperature and low-humidity (temperature: 15° C., relative humidity: 10%) environment. Then, the charging roller No. 1 was removed, and the surface of the charging roller equivalent to the position of the chipping of the cleaner blade was visually observed, to evaluate the charging roller based on the following criteria (Evaluation 7-1).

Rank A: Dirt cannot be confirmed in the circumferential direction of the surface of the charging roller.

Rank B: Minimal dirt can be confirmed in the circumferential direction of the surface of the charging roller.

Rank C: Toner dirt can be confirmed in the circumferential direction of the surface of the charging roller.

Rank D: Remarkable toner dirt can be confirmed in the circumferential direction of the surface of the charging roller.

Furthermore, the image performance at the image position equivalent to the position of the chipping of the cleaner blade using the fifth halftone image was ranked based on the following criteria (Evaluation 7-2).

Rank A: A longitudinal streak image cannot be confirmed at all.

Rank B: A longitudinal streak image can be hardly confirmed.

Rank C: A longitudinal streak image can be confirmed.

Rank D: A longitudinal streak image can be clearly confirmed in a belt form.

These evaluation results were shown with the rank of "7-1/7-2" in Tables 10 and 11.

[Evaluation 8] Dirt Evaluation (Cleaner-less)

The process cartridge (trade name: "HP 36A (CB436A)", manufactured by HP Inc.) from which the accompanying charging roller and cleaning blade was detached was equipped with the charging roller No. 1 as the charging roller. A gear for rotating the charging roller with a circumferential speed difference of 105% in a forward direction with respect to the rotation of the photosensitive member was attached to the charging roller. The process cartridge was loaded in the laser beam printer (trade name: HP LaserJet P1505 Printer, manufactured by HP Inc.). Five solid black images and one halftone image were formed under a low-temperature and low-humidity (temperature: 15° C., relative humidity: 10%) environment. Then, the charging roller No. 1 was removed, and the surface of the charging roller was visually observed to evaluate the charging roller based on the following criteria (Evaluation 8-1).

Rank A: Dirt cannot be confirmed on the surface of the charging roller.

Rank B: Minimal dirt can be confirmed on the surface of the charging roller.

Rank C: Massive toner dirt can be confirmed on the surface of the charging roller.

Rank D: Massive remarkable toner dirt can be confirmed on the surface of the charging roller.

Furthermore, the occurrence degree of a pinpoint image caused by massively aggregated transfer residual toner was visually observed using the sixth halftone image, and ranked based on the following criteria (Evaluation 8-2).

Rank A: A pinpoint image cannot be confirmed at all.

Rank B: A pinpoint image can be hardly confirmed.

Rank C: A pinpoint image can be confirmed.

Rank D: A pinpoint image can be clearly confirmed in a belt form.

These evaluation results were shown with the rank of "8-1/8-2" in Tables 10 and 11.

In Example 1, the surface shape such as the ratio Dr/L of the depth Dr of the concave portion to the distance L of the separation region, the film thickness of the surface layer, and the volume resistivity of the surface layer were proper. Therefore, all the performances of the longitudinal streak and pinpoint image caused by massive dirt regardless of the presence or absence of the cleaner had rank A, and the high image quality level was maintained.

Examples 2 to 20 and 22 to 29

Charging rollers No. 2 to 20, and 22 to 29 were produced in the same manner as in Example 1 except that an elastic layer forming roller No. 1 and a coating liquid No. 7-4 were used in combinations shown in Table 9.

Example 21

A coating liquid No. 7-4 was changed to a coating liquid No. 1 in the production of the charging roller No. 1 according to Example 1. A coated film of a coating liquid was formed on the outer circumference surface of the elastic roller No. 1, and then air-dried at a temperature of 23° C. for 30 minutes. Then, the coated film was dried at a temperature of 80° C. in a circulating hot air drier for 1 hour. Subsequently, the coated film was dried at a temperature of 160° C. for 1 hour. Charging roller No. 21 was produced in the same manner as in the charging roller No. 1 except for these conditions.

Comparative Examples 1 to 5

Charging rollers No. 31 to 35 were produced in the same manner as in Example 1 except that an elastic roller No. 1 and a coating liquid No. 7-4 were used in combinations shown in Table 9.

A concave portion derived from a concave portion of an elastic layer did not exist on the surfaces of the charging rollers No. 31 and 32.

Comparative Example 6

An elastic roller No. 1 was changed to a charging roller No. 36. That is, the charging roller No. 36 has no surface layer according to the present invention.

Comparative Example 7

A coated film of a coating liquid No. 6 was formed on the outer circumference surface of an elastic roller No. 1 by dipping. An immersion time was set to 9 seconds. The pulling-up speed of an elastic roller No. 6 from the coating liquid No. 6 was adjusted so that an initial speed was set to 20 mm/sec and a last speed was set to 2 mm/sec. The speed was linearly changed with respect to the time between 20 mm/sec and 2 mm/sec. Then, the coated film was air-dried at a temperature of 23° C. for 30 minutes, and then heated at a temperature of 160° C. for 1 hour, to obtain a charging roller No. 37. The film thickness of the covering layer was 3 μm.

TABLE 9

| | Charging roller No. | Elastic roller No. | Coating liquid No. |
|---|---|---|---|
| Example 1 | 1 | 1 | 7-4 |
| Example 2 | 2 | 3 | 7-4 |
| Example 3 | 3 | 4 | 7-4 |
| Example 4 | 4 | 5 | 7-4 |
| Example 5 | 5 | 6 | 7-4 |
| Example 6 | 6 | 8 | 7-4 |
| Example 7 | 7 | 9 | 7-4 |
| Example 8 | 8 | 10 | 7-4 |
| Example 9 | 9 | 11 | 7-4 |
| Example 10 | 10 | 12 | 7-4 |
| Example 11 | 11 | 13 | 7-4 |
| Example 12 | 12 | 14 | 7-4 |
| Example 13 | 13 | 15 | 7-4 |
| Example 14 | 14 | 17 | 7-4 |
| Example 15 | 15 | 1 | 7-1 |
| Example 16 | 16 | 1 | 7-2 |
| Example 17 | 17 | 1 | 7-3 |
| Example 18 | 18 | 1 | 7-5 |
| Example 19 | 19 | 1 | 7-6 |
| Example 20 | 20 | 1 | 8 |

TABLE 9-continued

| | Charging roller No. | Elastic roller No. | Coating liquid No. |
|---|---|---|---|
| Example 21 | 21 | 1 | 1 |
| Example 22 | 22 | 1 | 13 |
| Example 23 | 23 | 1 | 9 |
| Example 24 | 24 | 1 | 10 |
| Example 25 | 25 | 1 | 14 |
| Example 26 | 26 | 1 | 11 |
| Example 27 | 27 | 1 | 12 |
| Example 28 | 28 | 1 | 2 |
| Example 29 | 29 | 1 | 3 |
| Comparative Example 1 | 31 | 2 | 7-4 |
| Comparative Example 2 | 32 | 7 | 7-4 |
| Comparative Example 3 | 33 | 16 | 7-4 |
| Comparative Example 4 | 34 | 1 | 4 |
| Comparative Example 5 | 35 | 1 | 5 |
| Comparative Example 6 | 36 | 1 | — |
| Comparative Example 7 | 37 | 1 | 6 |

The evaluation results of the charging rollers No. 1 to 29, and 31 to 37 are shown in Tables 10 and 11.

TABLE 10

| | Distance L of separation region (μm) | Le/Lm ratio | Hp (μm) | Dr/L (%) | Orientation angle (°) | Film thickness of surface layer (μm) | $T_{min}$ (μm) | $T_{max}$ (μm) | Volume resistivity of surface layer (ΩCm) | Dirt evaluation 7-1/7-2 | Dirt evaluation 8-1/8-2 |
|---|---|---|---|---|---|---|---|---|---|---|---|
| Example 1 | 25 | 1.20 | 4.0 | 23 | 0 | 3.0 | 1.4 | 4.3 | 7.5E+15 | A/A | A/A |
| Example 2 | 9 | 1.05 | 4.1 | 55 | 0 | 3.0 | 1.5 | 4.1 | 7.5E+15 | C/C | C/C |
| Example 3 | 17 | 1.10 | 4.2 | 30 | 0 | 3.0 | 1.4 | 4.1 | 7.5E+15 | B/B | B/B |
| Example 4 | 18 | 1.10 | 4.0 | 22 | 0 | 3.0 | 1.6 | 4.0 | 7.5E+15 | A/A | A/A |
| Example 5 | 40 | 1.25 | 4.1 | 13 | 0 | 3.0 | 1.2 | 4.3 | 7.5E+15 | A/A | A/A |
| Example 6 | 15 | 1.15 | 1.5 | 17 | 0 | 3.0 | 2.2 | 4.0 | 7.5E+15 | C/C | C/C |
| Example 7 | 20 | 1.20 | 2.8 | 16 | 0 | 3.0 | 1.9 | 4.0 | 7.5E+15 | B/B | B/B |
| Example 8 | 40 | 1.25 | 7.0 | 20 | 0 | 3.0 | 1.4 | 4.3 | 7.5E+15 | A/A | A/A |
| Example 9 | 55 | 1.30 | 8.5 | 21 | 0 | 3.0 | 1.2 | 4.2 | 7.5E+15 | A/A | B/B |
| Example 10 | 90 | 1.40 | 18.5 | 24 | 0 | 3.0 | 1.1 | 4.4 | 7.5E+15 | C/C | C/C |
| Example 11 | 25 | 1.30 | 4.5 | 14 | 0 | 3.0 | 1.4 | 4.1 | 7.5E+15 | A/A | A/A |
| Example 12 | 25 | 1.30 | 4.0 | 20 | 0 | 3.0 | 1.6 | 4.2 | 7.5E+15 | A/A | A/A |
| Example 13 | 30 | 1.25 | 4.5 | 18 | 0 | 3.0 | 1.5 | 4.1 | 7.5E+15 | A/A | A/A |
| Example 14 | 25 | 1.30 | 4.0 | 20 | 0 | 3.0 | 1.5 | 4.3 | 7.5E+15 | A/A | B/B |
| Example 15 | 25 | 1.20 | 4.0 | 23 | 0 | 0.5 | 0.2 | 0.9 | 7.5E+15 | C/C | C/C |
| Example 16 | 25 | 1.20 | 4.0 | 23 | 0 | 0.9 | 0.4 | 1.3 | 7.5E+15 | C/C | C/C |
| Example 17 | 25 | 1.20 | 4.0 | 23 | 0 | 1.0 | 0.6 | 1.9 | 7.5E+15 | A/A | B/B |
| Example 18 | 25 | 1.20 | 4.0 | 23 | 0 | 5.0 | 2.7 | 5.9 | 7.5E+15 | A/A | B/B |
| Example 19 | 25 | 1.20 | 4.0 | 23 | 0 | 5.1 | 3.0 | 6.5 | 7.5E+15 | C/C | C/C |
| Example 20 | 25 | 1.20 | 4.0 | 23 | 0 | 3.0 | 1.4 | 4.1 | 8.5E+15 | A/A | A/A |

TABLE 11

| | Distance L of separation region (μm) | Le/Lm ratio | Hp (μm) | Dr/L (%) | Orientation angle (°) | Film thickness of surface layer (μm) | $T_{min}$ (μm) | $T_{max}$ (μm) | Volume resistivity of surface layer (ΩCm) | Dirt evaluation 8-1/8-2 | Dirt evaluation 9-1/9-2 |
|---|---|---|---|---|---|---|---|---|---|---|---|
| Example 21 | 25 | 1.20 | 4.0 | 23 | 0 | 3.0 | 1.6 | 4.1 | 4.5E+15 | A/A | A/A |
| Example 22 | 25 | 1.20 | 4.0 | 23 | 0 | 3.0 | 1.5 | 4.0 | 7.4E+15 | A/A | A/A |
| Example 23 | 25 | 1.20 | 4.0 | 23 | 0 | 3.0 | 1.3 | 4.3 | 6.6E+15 | A/A | A/A |
| Example 24 | 25 | 1.20 | 4.0 | 23 | 0 | 3.0 | 1.5 | 4.0 | 5.5E+15 | A/A | A/A |
| Example 25 | 25 | 1.20 | 4.0 | 23 | 0 | 3.0 | 1.6 | 4.0 | 7.5E+15 | A/A | A/A |
| Example 26 | 25 | 1.20 | 4.0 | 23 | 0 | 3.0 | 1.5 | 4.3 | 7.1E+15 | A/A | A/A |
| Example 27 | 25 | 1.20 | 4.0 | 23 | 0 | 3.0 | 1.4 | 4.1 | 5.5E+15 | A/A | A/A |
| Example 28 | 25 | 1.20 | 4.0 | 23 | 0 | 3.0 | 1.4 | 4.2 | 4.2E+15 | A/A | A/A |
| Example 29 | 25 | 1.20 | 4.0 | 23 | 0 | 3.0 | 1.3 | 4.1 | 3.2E+15 | A/A | A/A |
| Comparative Example 1 | 0 | — | 3.0 | — | — | 3.0 | 1.5 | 4.2 | 7.5E+15 | C/C | D/D |
| Comparative Example 2 | — | — | — | — | — | 3.0 | 2.0 | 4.0 | 7.5E+15 | C/C | D/D |
| Comparative Example 3 | 25 | 1.20 | 3.0 | 20 | 0 | 3.0 | 1.6 | 4.4 | 7.5E+15 | C/C | D/D |
| Comparative Example 4 | 25 | 1.20 | 4.0 | 23 | 0 | 3.0 | 1.4 | 4.2 | 3.2E+10 | D/D | D/D |
| Comparative Example 5 | 25 | 1.20 | 4.0 | 23 | 0 | 3.0 | 1.5 | 4.2 | 9.5E+14 | D/D | D/D |

TABLE 11-continued

| | Distance L of separation region (μm) | Le/Lm ratio | Hp (μm) | Dr/L (%) | Orientation angle (°) | Film thickness of surface layer (μm) | $T_{min}$ (μm) | $T_{max}$ (μm) | Volume resistivity of surface layer (ΩCm) | Dirt evaluation 8-1/8-2 | Dirt evaluation 9-1/9-2 |
|---|---|---|---|---|---|---|---|---|---|---|---|
| Comparative Example 6 | 25 | 1.20 | 4.0 | 23 | 0 | — | — | — | — | D/D | D/D |
| Comparative Example 7 | 25 | 1.20 | 4.0 | 23 | 0 | 3.0 | 1.6 | 4.3 | 1.0E+12 | D/D | D/D |

[Evaluation Results and Considerations]

All the sphericities (shape factors SF1) of the spherical particles used for Examples 1 to 29 and Comparative Examples 1 to 7 were 100 or more and 160 or less.

From Table 7, in the charging members of Examples 1 to 29 according to the present invention, the rank of dirt evaluation was A to C in both the case of having a cleaner and the case of cleaner-less.

In Examples 1 to 5, as the distance L of the separation region was increased, the dirt evaluation tended to be improved. In Examples 6 to 9, as the average particle size Dm of the insulating particles was increased, the dirt evaluation tended to be improved. In Example 10, the average particle size Dm of the insulating particles was 40 μm which was a very large value, and the rank of the dirt evaluation was C because of local dirt caused by discharge shortage from the convex portion. In Examples 15 to 18, as the film thickness of the surface layer was increased, the dirt evaluation tended to be improved. In Example 19, as the film thickness was increased, and the rank of the dirt evaluation was C because of dirt caused by discharge shortage between the surface of the charging member and the photosensitive member. In Examples 20 to 29, the high volume resistivity of the surface layer was sufficiently high, and the rank of the dirt evaluation was A.

On the other hand, since Comparative Example 1 had no concave portion, a local electric field from the convex portion was not inclined, and the rank of the dirt evaluation was D. Since Comparative example 2 had no insulating particle, a local electric field did not occur, and the rank of the dirt evaluation was D. Since Comparative Example 3 had the insulating particle having electro-conductivity, a local electric field did not occur, and the rank of the dirt evaluation was D. Since Comparative Examples 4, 5, and 7 had the surface layer having low volume resistivity, the charge up-of the surface layer attenuated, and the rank of the dirt evaluation was D. Since Comparative Example 6 had no surface layer, the charge-up of the surface of the roller did not occur, and the rank of the dirt evaluation was D.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-213356, filed Oct. 31, 2016, which is hereby incorporated by reference herein in its entirety.

What is claimed is:

1. A charging member comprising in this order:

an electro-conductive substrate;

an elastic layer comprising an outer surface having concave portions holding insulating particles, the insulating particles being exposed to the surface of the elastic layer; and a surface layer, wherein when an orthogonal projection image is obtained by orthogonally projecting each of the concave portions and the insulating particles held in the respective concave portions on a surface of the electro-conductive substrate, a site exists in which an outer edge of the orthogonal projection image derived from each of the insulating particles and an outer edge of the orthogonal projection image derived from each of the concave portions are separated, a surface of the charging member has convex portions derived from the insulating particles exposed to the surface of the elastic layer, and concave portions derived from the concave portions of the elastic layer, and the surface layer has a volume resistivity of $1.0\times10^{15}$ Ω·cm or more.

2. The charging member according to claim 1, wherein a maximum value $T_{max}$ of a film thickness of the surface layer is 5 μm or less, and a minimum value $T_{min}$ of the film thickness is 1 μm or more.

3. The charging member according to claim 1, wherein in the orthogonal projection image, an average value of acute angles is 0° to less than 45° each of the acute angles being formed by a longitudinal direction of the charging member and a line segment connecting (i) a center of gravity of a gap formed by separation of each of the insulating particles and each of the concave portions, and (ii) a center of gravity of each of the insulating particles.

4. The charging member according to claim 1, wherein the insulating particles have spherical shape having an average particle size Dm of 6 to 20 μm, and a length L of a longest line segment including an intersection point of a straight line drawn in a normal direction from the outer edge A of each of the spherical particle in the orthographic view with the outer edge B of each of the concave portions is at least 2·Dm.

5. The charging member according to claim 4, wherein the concave portion has a depth of 0.10×L or more with respect to the average height of the surface layer.

6. The charging member according to claim 1, wherein the surface layer contains a binder resin having a polyolefin skeleton.

7. The charging member according to claim 6, wherein the polyolefin skeleton is a polyisobutylene skeleton.

8. The charging member according to claim 1, wherein the height of the convex portion is higher than the average height of the surface layer.

9. The charging member according to claim 8, wherein the convex portion is higher than the average height of the surface layer by 3 μm or more.

10. The charging member according to claim 1, wherein each of the concave portions has a depth Dr of ⅓ or more of the average particle size Dm of the insulating particles.

11. A process cartridge configured to be detachably attachable to a body of an electrophotographic image forming apparatus, the process cartridge comprising an image bearing member and a charging member disposed in contact with the image bearing member, the charging member comprising in this order:

an electro-conductive substrate;

an elastic layer comprising an outer surface having concave portions holding insulating particles, the insulating particles being exposed to the surface of the elastic layer; and a surface layer, wherein when an orthogonal projection image is obtained by orthogonally projecting each of the concave portions and the insulating particles held in the respective concave portions on a surface of the electro-conductive substrate, a site exists in which an outer edge of the orthogonal projection image derived from each of the insulating particles and an outer edge of the orthogonal projection image derived from each of the concave portions are separated, a surface of the charging member has convex portions derived from the insulating particles exposed to the surface of the elastic layer, and concave portions derived from the concave portions of the elastic layer, and the surface layer has a volume resistivity of $1.0\times10^{15}$ Ω·cm or more.

* * * * *